United States Patent [19]

Moser

[11] Patent Number: 4,930,229

[45] Date of Patent: Jun. 5, 1990

[54] METHOD AND APPARATUS FOR AERATION OF STORED GRAIN WITH PROACTIVE COOLING

[75] Inventor: Wayne A. Moser, Minneapolis, Minn.

[73] Assignee: Sentry Technologies, Inc., Chanhassen, Minn.

[21] Appl. No.: 315,299

[22] Filed: Feb. 23, 1989

[51] Int. Cl.[5] ..... F26B 3/06

[52] U.S. Cl. ..... 34/34; 34/46; 34/54

[58] Field of Search ..... 34/54, 29, 34, 46; 236/44 R, 44 C, 44 E, 49; 98/53, 55; 374/102, 103, 108

[56] References Cited

U.S. PATENT DOCUMENTS

| | | |
|---|---|---|
| 3,408,747 | 11/1968 | Steffen . |
| 3,563,460 | 2/1971 | Nine . |
| 4,045,878 | 9/1977 | Steffen . |
| 4,175,418 | 11/1979 | Steffen et al. . |
| 4,471,424 | 9/1984 | Persson . |
| 4,522,335 | 6/1985 | Kallestad et al. . |
| 4,583,300 | 4/1986 | Mast . |
| 4,688,332 | 8/1987 | Kallestad et al. . |

OTHER PUBLICATIONS

*Natural Air and Low Heat Grain Drying and Storage Controller,* Duane L. Bollwitt (The Bollwitt Co., Inc.), Jan. 25, 1983, Monticello, Ia.

*Programmable Control for Drying and Aeration,* Gleelyn W. Persson (Pertek, Inc.), Robert W. Churchill (Hartrun Corporation), date and place of publication unknown.

Pertek, Inc., 2 page sales brochure, author, date and place of publication unknown.

*Primary Examiner*—Henry A. Bennett

*Attorney, Agent, or Firm*—Dorsey & Whitney

[57] ABSTRACT

A method and apparatus for the controlled aeration of stored grain is disclosed that provides for aeration of grain when ambient temperature and relative humidity levels are within a specified range of optimum levels. Available daily aeration time is selected by the operator and, if not used on a given day, is accumulated. Aeration of grain is initiated when the current ambient air temperature is within an acceptable range of the recent average air temperature, the equilibrium moisture content supported by the current air temperature and relative humidity levels is within an acceptable range of the desired grain moisture content and the available aeration time has not been used up. Long periods between aeration are avoided by progressively widening the range of acceptable current ambient air temperature and equilibrium moisture content levels when less than a predetermined amount of aeration has occurred. The method takes into account the actual average ambient temperature over specified short term and long term periods, and lowers the acceptable ambient temperature range for aeration of the stored grain by a specified offset from the range normally used, when the short term average ambient temperature is a specified amount lower than the long term average ambient temperature, signifying onset of a cooler season. The apparatus disclosed provides for continuous monitoring of ambient atmospheric conditions, and initiates aeration of stored grain automatically, in accordance with the inventive method, without continuous operator involvement.

26 Claims, 29 Drawing Sheets

57

METHOD AND APPARATUS FOR AERATION OF STORED GRAIN WITH PROACTIVE COOLING

BACKGROUND OF THE INVENTION

1. Field of the Invention

This invention relates to a method and apparatus for the controlled aeration of stored grain to prevent spoilage and to achieve a desired grain moisture content. More particularly, the invention relates to a method and apparatus for sensing ambient temperature and relative humidity conditions and selectively aerating grain when suitable or best-available ambient temperature and relative humidity conditions are present for achieving stable maintenance of grain moisture content at or near the moisture content level desired by the user and for cooling grain for safer storage.

2. Description of Prior Art

Mold is the major cause of spoilage in stored grain. Mold growth occurs when a moisture and temperature environment suitable for mold is present around the stored kernels. Foreign matter, along with higher temperatures and higher humidities, provide the most favorable environment for mold growth. Clean grain can be stored indefinitely in a storage bin if its moisture and temperature are kept within acceptable limits.

Moisture can be introduced into the air spaces around stored grain (a) by condensation or (b) by the natural respiration of the grain. Condensation can occur when relatively warm, moist air is introduced into the bin and comes into contact with grain that is colder than the air. Condensation more frequently occurs as a result of moisture migration, which happens when natural convection currents within the bin bring warm air from one region of the bin into contact with cooler grain in another region. Crusting and spoiling can result. It is known that the effects of condensation can be minimized by keeping the temperature of the grain at or near the average ambient air temperature.

Natural respiration of stored grain introduces moisture as a function of the temperature and relative humidity of the air surrounding the grain. For a specified temperature and relative humidity combination of the surrounding air, there is a corresponding equilibrium moisture content for the grain; that is, if the air surrounding the grain remains at the specified temperature and relative humidity conditions, the grain will eventually reach the corresponding equilibrium moisture content. Moisture will be given off by the grain kernels when the moisture content of the grain exceeds the equilibrium moisture content supported by the surrounding air conditions; conversely, moisture content of grain will increase when surrounding air conditions will lead to an equilibrium moisture content higher than that present in the grain kernels. In this regard, it should be noted that mold attacks a grain kernel from the outside in; it is the presence of excessive moisture on the outside of the kernel that is to be avoided.

Mold growth on stored grain can thus be restricted by controlling the moisture content and temperature of the grain. The grain temperature and moisture content determine the allowable storage time that the grain can be kept before it spoils. For that reason (and others), grain prices are adjusted for the moisture content of the grain. Grain which has an excessive moisture content must either be dried or used quickly and is therefore of less value than grain marketed at standard moisture content levels.

The effects of condensation can be controlled by maintaining the stored grain at a temperature equal (or nearly equal) to the temperature of the surrounding air. The effects of moisture release due to natural respiration could be avoided by excessively drying the grain. Excessive drying of grain, however, is undesirable for several reasons. First, grain that is at or below its equilibrium moisture content for the ambient air conditions, will not spontaneously give off moisture. It requires energy to remove each additional increment of moisture from a kernel as the kernel dries, and overdrying of the grain below its desired market moisture content consumes energy at an increasingly faster rate as the drying processes, with corresponding higher costs. Secondly, overdrying of grain creates internal stresses within the individual grain kernels cracks and fines, thus lowering the quality of the grain and its market value. Finally, grain is marketed by weight. Overdrying of grain removes more water than is necessary, thereby reducing its total weight. To maximize price, as much moisture should be retained in the kernels as possible, keeping in mind the upper allowable moisture content for safe storage and marketing standards.

Temperature plays an important role in the storage of grain not only because of condensation but because cooler grain, like other refrigerated foodstuffs, lasts longer. Molds grow far more easily at warmer temperatures (e.g., 70 degrees F. and above) than at lower temperatures (e.g., 40 degrees F. and below). Accordingly, subject to condensation problems, keeping grain at cooler temperatures is better.

Proper storage of grain, then, involves several important considerations. First, the temperature of the grain should be as close as possible to the average ambient temperature to avoid moisture migration and condensation. Secondly, the moisture content of the grain should be brought to and kept at a predetermined moisture content level that maximizes the weight of the grain at market time, yet is low enough to be stored safely. Third, grain should be stored at cool temperatures, where possible, and higher grain temperatures should be avoided. Fourth, as a corollary to the first and third considerations, if grain is cooled, its temperature should be lowered in small increments. An additional, economic consideration is that aeration used to achieve or maintain temperature and moisture content should not be performed more than necessary, as extensive aeration fan operation can lead to high energy costs.

U.S. Pat. No. 3,563,460 to Nine discloses a means for controlling the aeration of stored grain. The Nine device incorporates a plurality of temperature sensors located within the grain, and a comparison device for comparing the monitored temperature to a manually set temperature level. An aeration fan is activated when the grain temperature exceeds the set level. The Nine device, however, requires a continual manual adjustment of the set temperature level in order to maintain the grain temperature reasonably near the actual or average ambient temperature. Moreover, the Nine device does not include any mechanism, manual or automatic, to control aeration of the grain as a function of the relative humidity of the ambient air.

U.S. Pat. No. 4,045,878 to Steffen discloses a method for aerating stored grain wherein the stored grain is exposed to a throughput of atmospheric air if the current atmospheric conditions are optimal, in that they are at or near predetermined historical monthly average atmospheric conditions. Although the method disclosed in the Steffen patent, at least in theory, takes into consideration both temperature and relative humidity, application of the method has several drawbacks. First of all, continuous operator monitoring of ambient air conditions is required. Secondly, aeration of grain is premised on historical monthly temperature averages, and not on the actual current average temperature, which can vary considerably from historical seasonal averages. Finally, long periods of time may elapse without any aeration of the grain at all if the predetermined optimal air conditions are not met.

U.S. Pat. No. 4,522,335 to Kallestad et al., assigned to the assignee of the present application, disclosed a method and apparatus for controlled aeration of stored grain to maintain a specified desired grain moisture content. Current ambient temperature and relative humidity conditions are sensed. A running actual average temperature over a specified period is calculated and an equilibrium moisture content for a particular grain type corresponding to the ambient conditions is determined. Aeration is initiated when the current ambient air temperature is within a predetermined acceptable range of the running average ambient temperature and the equilibrium moisture content is within a predetermined acceptable range of the desired grain moisture content. Aeration time is operator-specified at a certain amount per day. If the specified aeration time is not used because ambient conditions are not within acceptable ranges, the unused aeration time is "banked", i.e., stored or backlogged for later use. The acceptable ranges for aeration are expanded in accordance with the increasing amount of time "banked".

U.S. Pat. No. 4,688,332 to Kallestad et al., also assigned to the assignee of the present application, discloses a method and apparatus for controlled aeration of stored grain similar to the method and apparatus of Patent No. 4,522,335. In Patent No. 4,688,332, however, the method and apparatus not only have storage modes but also modes for drying and rewetting grain and certain special and override modes. Also, this patent teaches determining an available amount of aeration time for a specified interval based on the difference between the grain temperature and average ambient temperature.

While useful, the inventions of U.S. Pat. Nos. 4,522,335 and 4,688,332 leave room for improvement. In field experience with these prior devices, it has been noted that, particularly in northerly climates with short falls and very cold winters, grain temperature tends to decrease significantly more slowly than ambient air temperature when such air temperature drops sharply to the freezing point and below. In such a temperature environment the control algorithm that works well for the rest of the year is less than optimal for fall and winter cooling. The lag in grain temperature as compared to ambient air temperature can lead to inadvertent overdrying of grain as it is cooled. It has also been found that while the rate of expansion of the acceptable range of relative humidity used in the prior devices works well for most conditions, in some extreme situations where temperatures are cool and little of the available aeration time has been used, a different rate of expansion can improve results.

A method and device for aeration of stored grain that promotes early cooling of stored grain when fall temperatures begin to drop and that provides more intelligent expansion of the acceptable relative humidity range would be a decided advantage.

SUMMARY OF THE INVENTION

The needs and shortcomings outlined above are in large measure addressed by the method and apparatus for controlled aeration of stored grain in accordance with the present invention. The invention provides for the controlled aeration of stored grain to reduce spoilage and achieve desired moisture content. The method is responsive to ambient temperature, grain temperature and relative humidity conditions, takes into account the actual average ambient temperature over specified short term and long term periods, determines an acceptable ambient temperature range around the short term average ambient temperature, and lowers the acceptable ambient temperature range for aeration of the stored grain by a specified offset from the range normally used, when the short term average ambient temperature is a specified amount lower than the long term average ambient temperature. The method leads to grain aeration under specified ambient temperature and relative humidity or equilibrium moisture content conditions that are optimal or "next best" as defined by ranges. The ranges for "next best" conditions can be expanded, including expansion of the relative humidity or equilibrium moisture content ranges at accelerated rates under certain conditions. Apparatus for performing the method is also part of the invention.

It is an objective of the present invention to provide a method and apparatus for aeration of stored grain that anticipates a cool season and initiates proactive cooling.

It is a further objective of the present invention to provide a method and apparatus for aeration of stored grain in which the acceptable conditions for aeration are adaptively adjusted depending on the amount of aeration performed and in which the pattern of adaptive adjustment is changed under certain temperature or relative humidity conditions.

DETAILED DESCRIPTION

Figure 1:
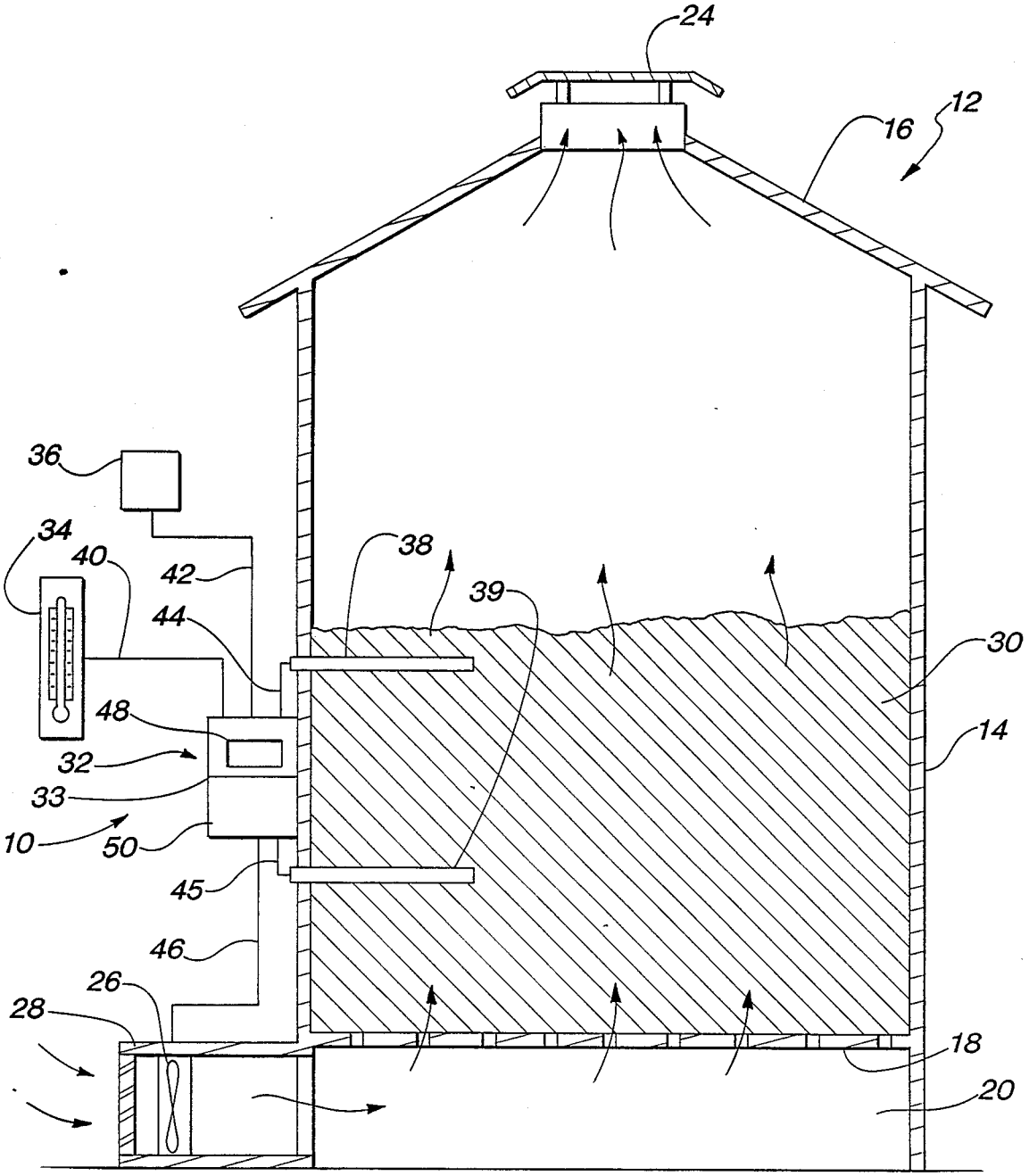
FIG. 1 is a schematic sectional diagram of a grain storage bin with an aeration fan controlled by the present invention.

Referring to FIG. 1, an apparatus 10 for the controlled aeration of stored grain in accordance with the present invention is depicted in conjunction with a grain storage bin 12.

The storage bin 12 includes an upright cylindrical side wall 14 and an apertured, frustoconical roof 16. The bin 12 also includes a raised, perforated floor 18, beneath which is an air-conducting plenum 20. At the uppermost point is a vent 24. An aeration fan 26 (which may actually be two or more fans) is received within conduit 28. Conduit 28 is connected to plenum 20 in an air communicating relationship. A quantity of grain 30 is depicted as being stored in the bin 12.

The control apparatus 10 broadly includes a control box 32 attached to the external face of side wall 14, ambient air temperature sensing device 34, ambient relative humidity sensing device 36, and grain temperature sensing probes 38, 39, all connected to control box 32 by respective leads 40, 42, 44, 45. Control cable 46 extends from the control box 32 to the fan 26 for selective operation of the fan 26.

Figure 2:
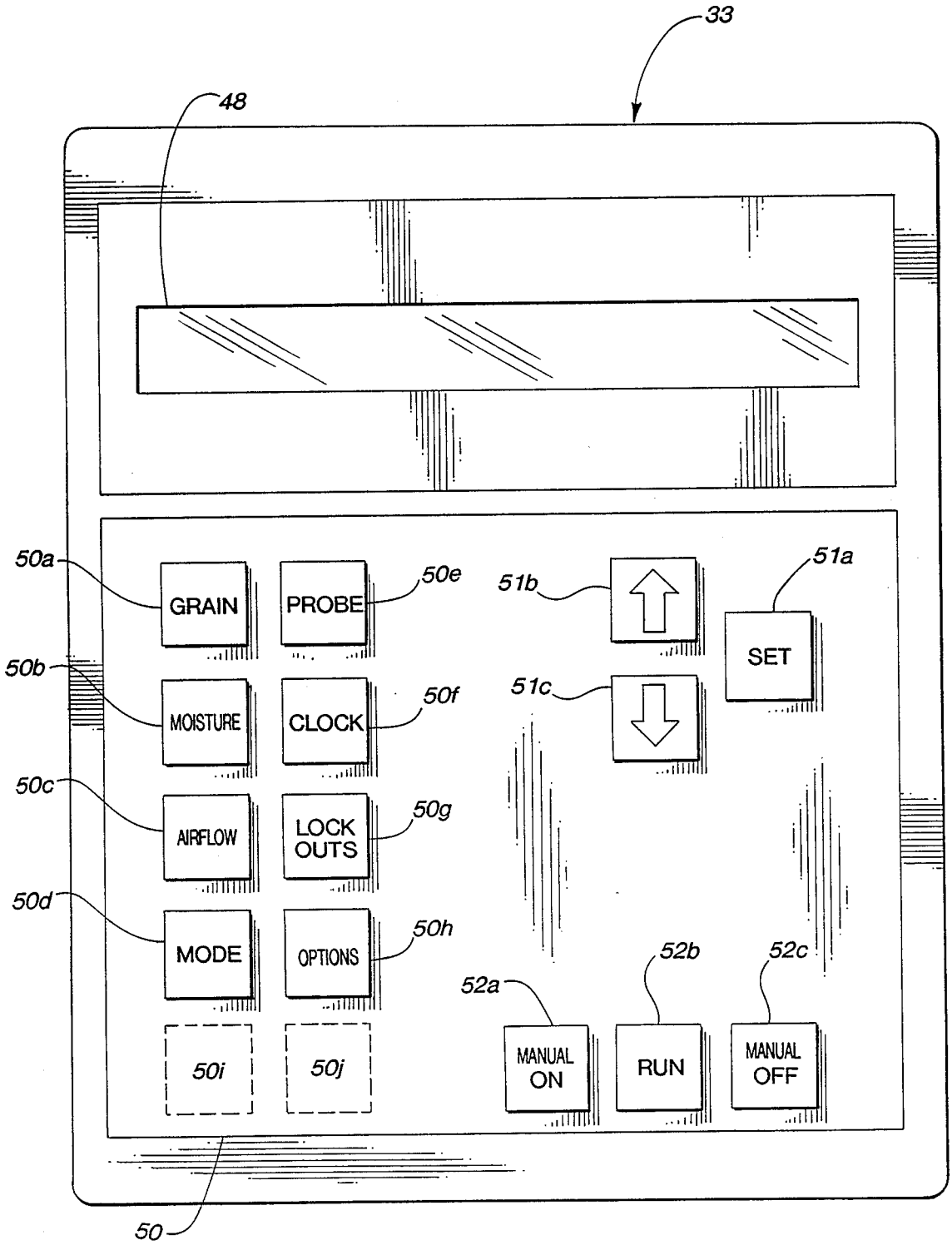
FIG. 2 is a schematic diagram of the control face plate of an apparatus embodying the present invention.

Control box 32 has a control panel 33 that includes a visual display 48, and input key panel 50 for operator input of controller functions. As best seen in FIG. 2, input key panel 50, which is preferably a membrane switch type keyboard has the following keys: GRAIN, MOISTURE, AIRFLOW, MODE, PROBE, CLOCK, LOCK OUTS, OPTIONS, MANUAL ON, RUN and MANUAL OFF **50*a*–50*h*, respectively. Also included is a SET key 51*a*, with two associated scrolling control key 51*b*, 51*c*, one having an arrow pointing up and the other having an arrow pointing down. These control keys permit the operator to display and select (SET) system parameters, including grain type, desired grain moisture level, grain control mode, the desired time of daily fan operation, times excluded for fan operation and other options, as will be explained in greater detail below. Additional MANUAL ON, RUN and MANUAL OFF keys 52*a*–52*c*, respectively, complete the visible control keys. If desired, two hidden keys 50*i*, 50*j*, with no visible markings may be provided for specialized functions. Control box 32** contains a microprocessor, memory and other circuitry for performing the information processing required by the control system, as will also be explained in greater detail below.

Figure 3:
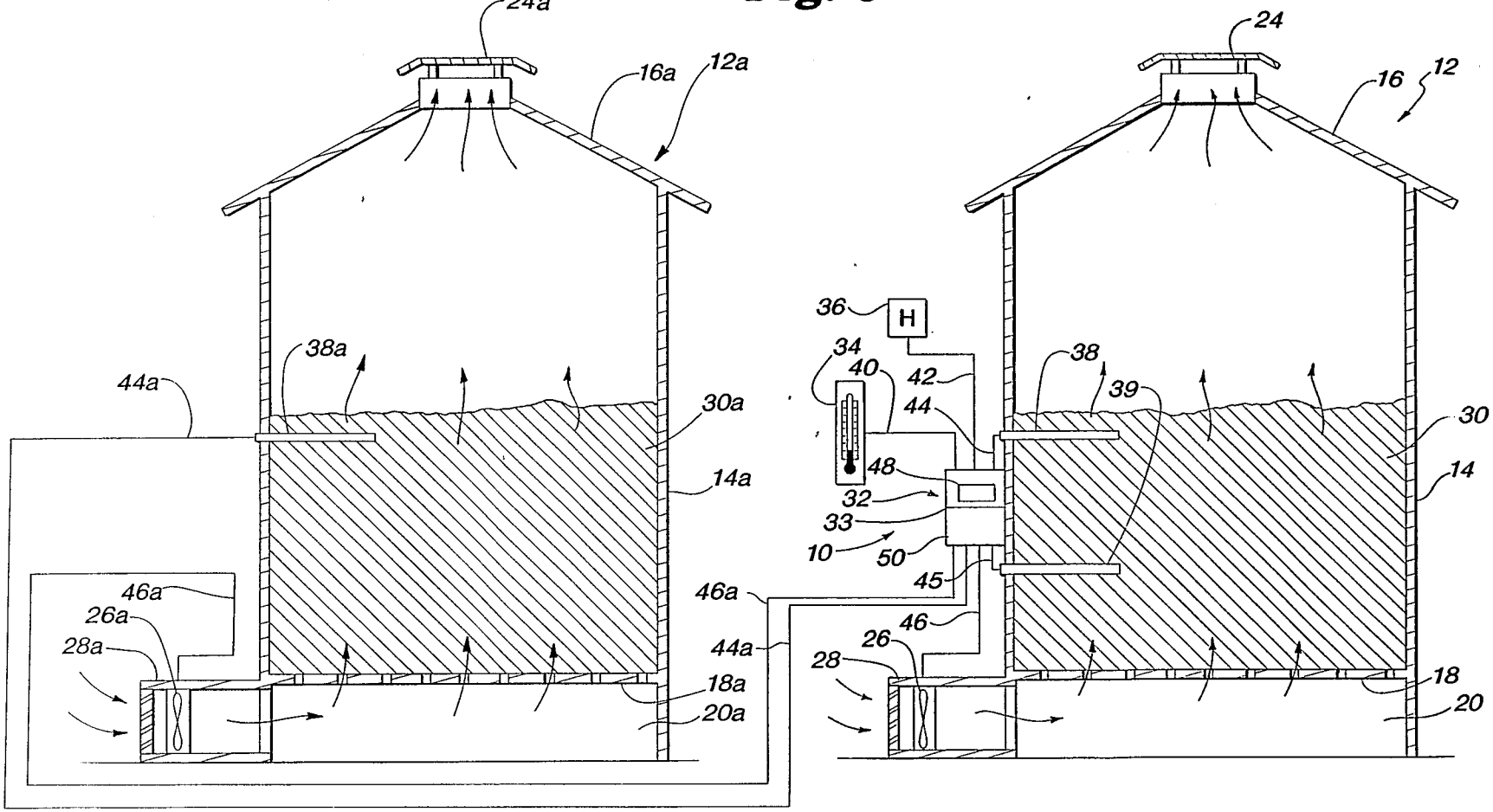
FIG. 3 is a schematic diagram of a pair of bins, both controlled by an apparatus embodying the present invention.

The control apparatus 10 can be used to control more than one bin. In FIG. 3, the controller 10 is associated with a first bin 12 identical to that of FIG. 1, but, in addition is also connected to a second bin **12*a*. Bin 12*a* has an upright cylindrical side wall 14*a* and an apertured, frustoconical roof 16*a*. It also has a raised, perforated floor 18*a*, beneath which is an air-conducting plenum 20*a*. At the uppermost point is a vent 24*a*. An aeration fan 26*a* is received within conduit 28*a* connected to the plenum 20*a*. A quantity of grain 30*a* is stored in the bin 12*a***.

Bin **12*a* is connected to the control apparatus 10 via control cable 46*a* to the fan 26*a* and sensor lead 44*a* leading to the grain sensor 38*a*. As will be seen, the control apparatus can receive input from up to three grain sensors allocated in any way between the two bins 12, 12*a*. The temperature sensor 34 and humidity sensor 36 need not be duplicated, because they measure ambient conditions to which both bins 12, 12*a*** are exposed.

The method for controlling the aeration of grain in accordance with the present invention will now be described. For simplicity, reference is made to only a single bin 12. When two bins are controlled, the same control options are available for each.

General Method for Aeration

The primary input data for the present method are ambient temperature, ambient relative humidity, grain type, desired grain moisture content and desired time of daily fan operation. It is known that for a given type of grain, the ambient temperature and relative humidity determine an equilibrium moisture content (or EMC), which represents the moisture content that the grain will equalize to if exposed for a prolonged period to that temperature and relative humidity condition. The EMC for a particular type of grain at specified ambient conditions can be determined either from a table of known values, or from a mathematical formulation which approximates the data in such a table. An example of a table appears at page 6 of "Low Temperature & Solar Grain Drying Handbook" published by Midwest Plan Service, Copyright 1980. Examples of mathematical formulae useful in determining EMC are the Chung-Pfost equation explained in American Society of Agricultural Engineers (ASAE) paper 76-3520 or, preferably, the EMC/ERH equations explained in ASAE paper 88-6068 (incorporated herein by reference).

Once the EMC at ambient temperature and humidity (in the following all references to humidity shall mean relative humidity unless otherwise stated) conditions is known, this value can be used as part of a determination to aerate or not aerate. In general, aeration under control of the present invention will serve one of three functions. First, the operator may wish to maintain a preselected desired level of moisture content already present (or nearly present) in the grain (maintenance mode). Second, the operator may wish to move grain which is not presently at a desired moisture content toward the desired moisture content, whether that is wetter or drier than current conditions (wetting/drying modes). Third, the system may need to intervene to protect grain that is endangered by internal temperatures rising too far above the average ambient temperature (override modes).

In the preferred embodiment, control apparatus 10 supports the following aeration control modes, explained in greater detail below:

STORAGE 1–3
REWETTING 1–5
DRYING 1–5
SPECIAL 1–2

In addition, certain override features change the preceding control modes when override conditions are encountered.

The aeration fan 26 of the grain storage bin 12 can be selectively actuated when ambient conditions or grain temperature indicate the desirability of or the need for aeration. Actuation of the fan 26 will expose the grain 30 to a throughput of air at ambient temperature and humidity conditions, thereby causing the grain 30 to move toward ambient temperature and a moisture content equal to the EMC determined by those ambient conditions.

Maintenance Mode

Aeration of stored grain when the ambient conditions support an EMC within predetermined limits of the desired moisture content of the grain will minimize the accumulation of moisture due to natural respiration of the grain kernels. As described above, however, moisture also accumulates within a quantity of stored grain due to the effects of condensation when the grain is exposed to moist air having a warmer temperature than the grain itself. The effects of such condensation are best limited by keeping the temperature of the stored grain at the temperature of the ambient air. Thus, in the maintenance mode, the invention must take into account both EMC and ambient temperature.

Unfortunately, maintaining grain at ambient temperature frequently cannot be done with precision, because the air temperature changes far more quickly than the temperature of a large mass of stored grain. Moreover, if aeration were initiated whenever grain temperature and ambient temperature differed, in a continuous attempt to track ambient temperature, significant amounts of energy would be consumed by the aeration fan.

A possible solution is to make use of historical data on average monthly or seasonal temperatures, on the theory that if the grain can be maintained at the average monthly or seasonal temperature, this will avoid wide differences between the temperature of the stored grain and the actual ambient temperature. With this approach, aeration would be used whenever grain temperature and the historical average monthly or seasonal temperature differ. Actual temperatures on a daily, monthly or seasonal basis, however, often vary by large amounts from historical averages. Moreover, historical temperatures vary by geographical region, and different data would be required by each region.

The present invention, like U.S. Pat. Nos. 4,522,335 and 4,688,332, rejects both the attempt to track continuously the ambient temperature and reliance on historical monthly or seasonal averages. Instead, it has been determined that an actual average temperature computed over a specified averaging period (three weeks in the preferred embodiment, but periods of one week to four weeks might be used) produces excellent results in controlling moisture accumulation within stored grain, when this average is used as the centerpoint of a temperature range within which the control system causes grain to be aerated. In the preferred embodiment, a three week running average is maintained by determining the ambient temperature every fifteen minutes in a given twenty-four hour period and averaging the ninety-six temperature readings obtained within the twenty-four period to determine a daily average temperature. The three week running average temperature is the average of the most recent twenty-one daily averages.

From the foregoing it can be seen that the basic aeration control philosophy of the maintenance mode of the present invention is to initiate aeration only when (a) ambient temperature and humidity conditions determine an EMC which is at or near the desired grain moisture content, and (b) the ambient temperature is at or near the running average ambient temperature. It is recognized, however, that precisely optimum air temperature and humidity conditions may not occur for long periods and may not persist when they do occur. It is desirable, therefore, to effect aeration of stored grain when the ambient temperature and humidity are within certain predetermined ranges of the optimum conditions. The limit values selected to define these predetermined ranges in the preferred embodiment are described in greater detail below. At this point it suffices to say that the range around the running average temperature could be as large as plus or minus 50° F., while the range around the desired grain moistur content could be as large as plus or minus 10 moisture percentage points around the desired grain moisture content. (Typical ranges will, however, be much narrower than this.)

The fundamental steps for the method of controlled aeration of stored grain in accordance with the maintenance mode of the present invention can be summarized as follows. First, the desired moisture content of the particular type of stored grain is selected. Second, the actual ambient temperature and humidity conditions are measured and the ambient equilibrium moisture content (EMC) is determined from these values and the grain type. Third, a running average temperature is calculated. Fourth, the ambient EMC is compared to the desired moisture content of the stored grain, and the actual temperature is compared to the running average temperature. Fifth, it is determined whether there is available aeration time based on operator selected daily desired aeration time and/or aeration time from other days that has not been used and is therefore accumulated. Finally, a control signal to trigger actuation of the grain storage bin aeration fan 26 is only issued if the ambient EMC is within a predetermined range of the desired grain moisture content, the actual air temperature is within a predetermined range of the running average ambient temperature and there is available aeration time. The manner in which these predetermined ranges are defined is described next. One of the factors affecting the way in which the ranges are defined is the cost of aeration.

Grain within a storage bin will maintain its moisture content and temperature over a period of time due to the semi-isolated environment of the storage bin and the inherent insulative property of the grain mass. There is no need to continuously aerate the grain, even if optimum atmospheric conditions persist. Moreover, energy consumption by an aeration fan can be a significant cost consideration, and it is desirable to operate the fan no more than is necessary. Accordingly, the method and apparatus of the present invention provide for operator selection of the desired run time of the aeration fan during a twenty-four hour period. (Automatic selection of run time could also be done, in accordance with the teachings of U.S. Pat. No. 4,688,332.)

With operator selection, the operator selects and inputs the desired run time of the aeration fan, based on the size of the fan and its corresponding air moving capacity and energy consumption rate. While various time choice options might be used, in the preferred embodiment the operator may choose fan operation time in fifteen minute segments, selecting within the range from 15 minutes to twenty hours in fifteen minute increments for a twenty-four hour period. (As explained in greater detail below, selection is made from values displayed at the control box 32.) As will be seen below, the desired aeration (fan operation) time parameter effects several aspects of the present method.

Because precisely optimal ambient conditions will seldom be encountered, an initial range is defined for both the running average ambient temperature and the desired grain moisture content within which aeration will be initiated if aeration time is available. In the preferred embodiment the initial predetermined range around the running average ambient temperature is $\pm 1°$ F. For desired grain moisture content, the initial range is defined such that when the ambient air and humidity conditions together determine an EMC within $\pm 0.45$ percent of the desired grain moisture content, the EMC condition for aeration will be satisfied. Actual ambient temperature and humidity are sampled every fifteen minutes and if the dual conditions are satisfied, fan operation is initiated for the next fifteen minutes, if the available fan operation time has not been used up.

In addition to the initial ranges, the invention accomodates the possibility that ambient conditions within the initially defined acceptable temperature and EMC ranges may not be met for a long period of time or, if met briefly, will not persist. In that event, the aeration fan will not be actuated at all or will be actuated for only brief periods. This likely will not endanger the grain. The temperature and moisture content of the grain, when the fan is not activated, will in large measure be maintained by the semi-isolated environment of the storage bin. On the other hand, it will be appreciated that respiration of grain kernels and moisture migration may continue, and, without proper aeration, there will be an accumulation of moisture within the stored grain, and a possible change in grain moisture content. Moreover, due to heat released by grain respiration, the grain will not maintain its temperature indefinitely in the absence of aeration. The drift of the grain from optimum moisture content and temperature levels may become larger as the period of insufficient aeration increases. It will also be appreciated that, as the drift from optimum grain moisture content and temperature levels increases, the amount of aeration to restore the grain to optimum conditions correspondingly increases. In order to accomodate such circumstances, the present invention adaptively adjusts its control parameters. First, it adapts by "banking" or backlogging unused aeration time, thus preparing to aerate for longer-than-normal periods when acceptable conditions are finally encountered. Second, it selects a continually widening range of "next best", acceptable ambient temperature and EMC conditions so that, even when conditions within predetermined, initial optimum ranges are not met, the grain within the storage bin will receive some aeration. This occurs as follows.

As set forth above, the desired run time of the aeration fan during any given twenty-four hour period is selected by the grain bin operator. If the ambient conditions in a twenty-four hour period do not fall within the predetermined, initial ranges and available aeration time is not fully used, then the amount of selected aeration left unused at the end of a twenty-four hour period will be "banked" or backlogged. For example, if no time has previously been "banked" and acceptable conditions are not met at all for two days, but are met on the third day, the run time available for the aeration fan on the third day will be three times the desired run time limit selected by the operator for a twenty-four hour period. The "banking" of unused run time automatically accounts for the facts that the grain may drift further from desired temperature and moisture content level as the time between aeration increases, and that more run time is required to bring the grain back to acceptable levels as the margin of drift from optimum levels increases.

The method of modifying initial ranges to select "next best" conditions for aeration utilizes the "banked" aeration time parameter. In particular, as the "banked" aeration time increases, the predetermined, initial ranges considered acceptable for aeration are expanded, so that the backlog of aeration time has a greater chance of being used. In the preferred embodiment, the ranges are increased somewhat differently in three variations of the storage mode. The values for STORAGE 1 mode are shown in the following table:

| "Banked" Fan Time | Temperature Range | EMC Range |
|---|---|---|
| 0–4 hrs. | ±1° F. | ±0.45% |
| 4.00–7.75 | ±1° F. | ±0.60% |
| 8.00–11.75 | ±2° F. | ±0.75% |
| 12.00–15.75 | ±2° F. | ±0.90% |
| 16.00–19.75 | ±3° F. | ±1.05% |
| 20.00–23.75 | ±3° F. | ±1.20% |
| 24.00–27.75 | ±4° F. | ±1.35% |
| 28.00–31.75 | ±4° F. | ±1.50% |
| 32.00–35.75 | ±5° F. | ±1.65% |
| 36.00–39.75 | ±5° F. | ±1.80% |
| 40.00–43.75 | ±6° F. | ±1.95% |
| 44.00–47.75 | ±6° F. | ±2.10% |
| 48.00–51.75 | ±7° F. | ±2.25% |
| 52.00–55.75 | ±7° F. | ±2.40% |
| 56.00–59.75 | ±8° F. | ±2.55% |
| 60.00–63.75 | ±8° F. | ±2.70% |
| 64.00–67.75 | ±9° F. | ±2.85% |
| 68.00–71.75 | ±9° F. | ±3.00% |
| 72.00–75.75 | ±10° F. | ±3.15% |
| 76.00–79.75 | ±10° F. | ±3.30% |
| 80.00–83.75 | ±11° F. | ±3.45% |
| 84.00–87.75 | ±11° F. | ±3.60% |
| 88.00–91.75 | ±12° F. | ±3.75% |
| 92.00–95.75 | ±12° F. | ±3.90% |
| 96.00–99.75 | ±13° F. | ±4.05% |

This sequence continues at a backlog of "banked" fan time of 100 hours and above. For every additional 4 hours of backlog, the EMC range will spread by ±0.15%. For every additional 8 hours of backlog, the temperature range will spread by ±1 degree F.

The tabular values are constantly used to define the acceptable operating ranges. For example, if the backlog is 60.75 hours, the range of weather conditions that the system will find acceptable to turn on the fan 26 will be ±8 degrees from the average ambient temperature and ±2.70% (EMC) from the desired moisture content setting.

As an alternative to the above approach to expanding the ranges of acceptable ambient conditions, two other expansion methods have been found useful. The first of these (STORAGE 2 mode) can be selected for storage mode operation of the invention in climates or seasons known to be predominantly dry rather than wet. In these climates or seasons a symmetrically expanded range would lead to drying of the grain because, as the range is expanded, more dry weather is encountered that is considered acceptable for aeration than wet weather. Aeration in this drier weather tends to push the grain toward greater dryness. Wet weather, being seldom encountered, does not counterbalance the increased aeration during dry weather. The remedy for this is found in a non-symmetrical expansion of the range around the desired EMC. In particular, the above table is modified by starting and holding the lower boundary of the desired EMC range at −0.2%, while the upper boundary increases as shown in the table. For example, for 8.00–11.75 hrs., the EMC range is from −0.2% to ±0.75%.

A similar expansion method is defined for predominantly wet weather (STORAGE 3 mode). To avoid excess wetting, the range is non-symmetrically expanded to include a broader range of ambient conditions on the dry side of the desired EMC. In particular, the above table is modified by starting and holding the upper boundary of the desired EMC range at +0.2%, while the lower boundary increases as shown in the table. For example, for 12.00–15.75 hrs., the EMC range is from −0.9% to +0.2%.

It will be appreciated that, as more time is "banked" in STORAGE 1, STORAGE 2 or STORAGE 3 modes, and the ranges of acceptable average temperature and EMC levels are accordingly increased, it becomes more and more likely that the aeration fan will be actuated. The time "banked" will then be decreased, time segment for time segment, once the fan is actually operated. As the "banked" time decreases, the ranges of acceptable temperature and EMC levels will accordingly be narrowed, in reverse sequence from the range widening progression.

An additional feature of the inventive method in the storage mode is a limit on the boundary values of the running average temperature range used as one of the aeration criteria. In the preferred embodiment, in order to avoid excessive cooling or heating of the stored grain during extreme weather, the running average temperature value used as the upper boundary of the ambient temperature range for aeration is never allowed to be more than five degrees F. greater than a predetermined upper limit for the ambient temperature range centerpoint. Similarly, the lower boundary for the ambient temperature range for aeration is never allowed to be more than five degrees F. less than a predetermined lower limit for the ambient temperature range centerpoint. In the preferred embodiment the upper and lower centerpoint limits are 60 degrees F. and 20 degrees F., respectively. That is, the range of acceptable temperatures for aeration is truncated so that the lower boundary value is limited to be no lower than 20° F. less 5° F.=15° F. and the upper boundary value is limited to be no higher than 60° F. plus 5° F.=65° F. These upper and lower limits may be varied for installations in different geographic areas. Overrides 2 and 3 (described below) override these limits.

For average ambient temperatures below forty degrees F., a further feature of the invention is invoked. This feature varies the range-widening progression set forth in the above table in still another way. This feature is activated when larger amounts of "banked" aeration time exist and air temperatures are relatively cool. It causes the EMC range values in the above table to be changed, so that the EMC range is wider than it would normally be. In particular, the EMC range limits are expanded by the following multiplier factors, applicable only when the three-week average ambient temperature is less than forty degrees F.:

| Banked Aeration Time | EMC Multiplier |
|---|---|
| Greater than or equal to 40 hrs. | 1.2 |
| Greater than or equal to 50 hrs. | 1.5 |
| Greater than or equal to 60 hrs. | 2.0 |

For example, if the three-week average ambient temperature is 30 degrees F. and there are fifty hours of "banked" aeration time, then the EMC Range is adjusted to ±3.375%. The ambient temperature is still 30 degrees F., ±7 degrees F.

For a three week average ambient temperature of 60 degrees F. or above, when the "banked" aeration time is greater than or equal to fifty hours, a still further feature of the invention applies an EMC Multiplier of 1.2, just as in the first case set forth in the immediately preceding table.

Fall Cooling Offset Feature

The method described thus far is very similar to that of U.S. Pat. No. 4,688,332. Where the present invention seeks to improve on the prior art is in the fall season. In northerly climates where much grain is grown and stored, the fall season is short and is usually characterized by a period of gradual cooling from late summer to early fall, then abrupt temperature drops to freezing and below as winter nears. It has been found that with the above control approach, the grain temperature tends to significantly lag the ambient air temperature in the fall. The result is that when the temperature drops sharply and the cold ambient air is used for aeration, it is warmed a great deal by the warm grain and its relative humidity drops sharply. The warmed air thus has a strong drying effect on the grain. This can cause overdrying and cracking.

The solution proposed by the present invention is to anticipate and recognize the fall season and to accelerate the cooling process relative to the previously described control approach. This proactive cooling approach permits the grain to start cooling sooner and to cool in smaller incremental steps. As a result, the drying effect of aerating with air much colder than the grain is reduced.

To accomplish this, the control apparatus 10 is programmed to perform certain additional method steps. First, to aid in recognizing the fall season, a long term average ambient temperature is calculated, in addition to the previously discussed three-week running average temperature (hereinafter called the short term average). The long term average is calculated in exactly the same manner as the short term average, except that it is preferably the average of daily temperatures over a six-week period rather than a three-week period. (Averages over from four to eight weeks would also be suitable, as long as the period for the long term average is significantly longer than for the short term average.)

Once a short term and a long term ambient temperature average are available, these value can be compared. When the short term average is less than the long term average by a specified amount, it can be concluded that a colder season is approaching. The specified amount of difference for recognition of a cold season could vary from about one degree F. to ten degrees F. Simulations based on historical weather data have shown that one degree F. is suitable, i.e., that fall can tentatively be recognized when the three-week average ambient temperature is more than one degree F. colder than the six-week running average.

Once the fall season is recognized, it is desirable to accelerate cooling. To accomplish this, the method of the present invention proposed shifting downward the ambient temperature range during which aeration can occur. With a downwardly shifted range, when cold weather begins to be encountered at the onset of fall, the cooler ambient temperatures will be within the range considered acceptable for aeration rather than outside it. In the preferred embodiment, the downward shifting or offset of the ambient temperature range is selected to be proportional to the difference between the short term and long term running average ambient temperations. In particular, the following offsets are preferred.

| Difference Between Short and Long Term Average Temperature | Downward Offset |
|---|---|
| 1° F. | 1° F. |
| 2° F. | 2° F. |
| 3° F. | 3° F. |
| 4° F. | 4° F. |
| 5° F. | 5° F. |

This sequence continues, with differences greater than 5° F. leading to a downward offset equal to the difference. The offset is applied by shifting downward the entire range of acceptable ambient temperature calculated by the normal control procedure. For symmetrical ranges, as in the preferred embodiment, this is easily done by simply subtracting the downward offset from the three week running average ambient temperature value that is normally used as the range centerpoint. For non-symmetrical ranges, the downward offset for proactive cooling would be applied to the upper and lower values of the normal aeration temperature range. The downward offset is applied for as long as the difference between short and long term average ambient temperatures shows that the short term average temperature is at least one degree F. cooler than the long term average. Thus, if unusual temperature variations cause the fall cooling offset feature to be invoked when it is not fall, the return to normal temperature patterns removes the offset. Also, as winter temperatures stabilize, the offset is no longer applied.

When the fall cooling offset is applied, the aeration control method as previously described functions exactly as before, except that the range of ambient temperatures during which aeration can occur is shifted downward. Aeration will still only occur when both ambient temperature and humidity/EMC range conditions are satisfied and there is available aeration time.

Wetting/Drying Modes

The storage modes previously discussed (as augmented by the fall cooling offset) are appropriate for maintaining grain at or near a desired moisture content. They are not, however, efficient for bringing grain which is far from a desired moisture content to that level. Because grain is often placed into storage at a moisture content higher than desired and because various difficult weather conditions or storage circumstances can cause grain to deviate from a desired moisture content by being either too wet or too dry, the present invention includes wetting and drying modes that are designed to use aeration at ambient conditions to achieve the desired moisture content.

If the operator desired to rewet dry grain, the invention offers five rewetting modes (REWETTING 1-5). If the operator desires to dry wet grain, the invention offers five drying modes (DRYING 1-5). In each of these, the user selects as an input value to the system the desired moisture content. As in the storage mode, ambient temperature and humidity are measured, the short term (three week) running average temperature is calculated and an EMC based on ambient temperature and humidity is determined.

Aeration is initiated in the rewetting modes as follows:

REWETTING 1—whenever EMC exceeds (is wetter than) the desired moisture content.

REWETTING 2—whenever EMC exceeds the desired moisture content and ambient temperature exceeds 40° F.

REWETTING 3—whenever EMC exceeds the desired moisture content and ambient temperature is both above 40° F. and within ±15° F. of the short term average temperature.

REWETTING 4—whenever EMC exceeds the desired moisture content and ambient temperature is both above 40° F. and wthin ±10°]F. of the short term average temperature.

REWETTING 5—whenever EMC exceeds the desired moisture content and the short term ambient temperature is both above 40° F. and within ±5° F. of average temperature.

As can be seen, the progression is from a mode in which aeration to cause rewetting will occur whenever possible (REWETTING 1), to more restrictive modes. Common to all remaining modes is a predetermined minimum temperature (in the preferred embodiment 40° F.) below which no aeration occurs. This is because air at lower temperatures carries very little moisture. Thus, aeration at such temperatures utilizes energy inefficiently for rewetting purposes.

Aeration is initiated in the drying modes as follows:

DRYING 1—whenever EMC is lower (drier) than the desired moisture content.

DRYING 2—whenever EMC is lower than the desired moisture content and ambient temperature exceeds 40° F.

DRYING—whenever EMC is lower than the desired moisture content and ambient temperature is both above 40° F. and within ±15° F. of the short term average temperature.

DRYING 4—whenever EMC is lower than the desired moisture content and ambient temperature is both above 40° F. and within ±10° F. of the short term average temperature.

DRYING 5—whenever EMC is lower than the desired moisture content and ambient temperature is both above 40° F. and within ±5° F. of the short term average temperature.

As with rewetting modes, the progression is from a mode in which aeration to cause drying will occur whenever possible (DRYING 1), to more restrictive modes. Common to all remaining modes is a minimum temperature (in the preferred embodiment 40° F.) below which no aeration occurs, because it is not accomplished efficiently with the small amounts of moisture that can be carried by cold air.

In none of the rewetting or drying modes is there any limit on aeration (fan operation) time nor is there a preset daily aeration time or "banking" of unused aeration time. The fan for aeration simply operates whenever predetermined ambient conditions are met.

Closely related to the previously described rewetting and drying modes are two "special" modes. In the first of these, SPECIAL 1, the operator selects both a desired grain moisture content and the acceptability ranges for aeration, similar to the ranges automatically determined by the invention in the storage modes. The default values for the acceptability ranges are ±5° F. around short term average temperature and ±0.1% around desired moisture content. These values can be reset by the operator to any desired set of symmetrical limits (within specified broad ranges). Fan operation time is not predetermined, and aeration will occur whenever ambient conditions fall within the specified acceptability ranges. The ranges do not expand or narrow unless reset by the operator.

The second "special" mode, SPECIAL 2, is identical to SPECIAL 1, except that in addition to selecting desired moisture content and symmetrical ranges around short term average temperature and desired moisture content, the operator also selects daily aeration time. Aeration then occurs whenever ambient conditions fall within the specified acceptability ranges and aeration time is available. Unused aeration time is "banked" for later use as in the storage modes, but the acceptability ranges do not expand or narrow based on a backlog of "banked" aeration time.

Override Modes

Maintaining stored grain at or bringing stored grain to a desired moisture content and maintaining grain at a temperature close to the running average air temperature are the primary factors to be considered in proper handling of stored grain. It will be appreciated, however, that excessively high or low grain temperatures indicate conditions which threaten grain and are to be avoided. Moreover, to reduce moisture migration and condensation within the grain, it is essential that grain temperatures be relatively uniform throughout the storage bin. The method in accordance with the present invention therefore provides for several "override" conditions that take precedence over aeration controlled solely as a function of ambient temperature and humidity/EMC in the manner described above, so as to avoid or alleviate extreme, or nonuniform grain temperatures.

The simplest of the available overrides is manual override, effected by user selection of manual control of fan. To do this the user simply selects the MANUAL ON (aeration is initiated) or the MANUAL OFF (aeration ceases) mode on control panel 33 and thus runs the aeration fans at his or her discretion. Also included in the invention are several automatic override features.

The first override feature requires the presence of one or more grain temperature probes (such as probe 38) and takes effect when the average grain temperature across all operating probes is not within ±9° F. of the short term running average temperature (including any offset applied). In this override mode (which functions only in the storage modes), the desired aeration fan operation time as set by the operator is considered to be doubled (up to a maximum of 20 hours per day) for purposes of running the aeration fans and/or "banking" unused aeration time. Thus, more aeration time becomes available, at twice the selected rate; if available aeration time is not used, aeration becomes more likely to occur due to the increase in banked aeration time, causing faster broadening of the acceptable temperature and EMC ranges for aeration. This override remains in effect until the grain temperature returns to within ±8° F. of the short term running average temperature (including any offset applied).

The second automatic override feature takes into consideration that the grain temperature (as measured by any one operating probe, such as probe 38) should never exceed the running average ambient temperature by a large margin. The method of grain aeration in accordance with this override calls for aeration of the grain, regardless of other conditions, when (a) the grain temperature at any one operating probe exceeds the short term running average ambient temperature (including any offset adjustment thereto currently being applied) by greater than 16° F., and (b) the actual ambient air temperature is at least 5° F. cooler than said grain temperature, and (c) the actual ambient humidity is not greater than 90 percent. Aeration pursuant to this override will continue until one of these conditions is no longer met. This override mode functions in all storage and rewetting/drying modes but not in the and special modes.

The third automatic override feature is similar to the second override feature described above. With this override (which functions in all storage, rewetting/drying and special modes), aeration of the grain occurs regardless of other conditions when (a) the grain temperature at any one operating probe exceeds the short term running average temperature (including any offset adjustment thereto currently being applied) by 31° F. and (b) the actual ambient air temperature is at least 15° F. cooler than said grain temperature. Humidity does not influence this override. This override remains in effect until one of these conditions is no longer present.

Other special conditions are recognized that exclude the preceding overrides. These conditions are triggered by the same temperatures measured at probes that are used to determine the applicability of the above automatic overrides. These conditions are as follows:

If all operating probe/grain temperatures are less than or equal to 60° F., then the third override above does not apply.

If all operating probe/grain temperatures are less than or equal to 50° F., then the second and third overrides above do not apply.

If the average of all operating probe/grain temperatures is less than or equal to 40° F. and neither of the two conditions immediately above is in effect, then the first, second and third overrides above do not apply.

If the short term average ambient temperature is greater than or equal to 60° F. and the average of all operating probe/grain temperatures is greater than or equal to 55° F., then the first override above does not apply.

Electronic Circuitry and Operator Inputs

Figure 4:
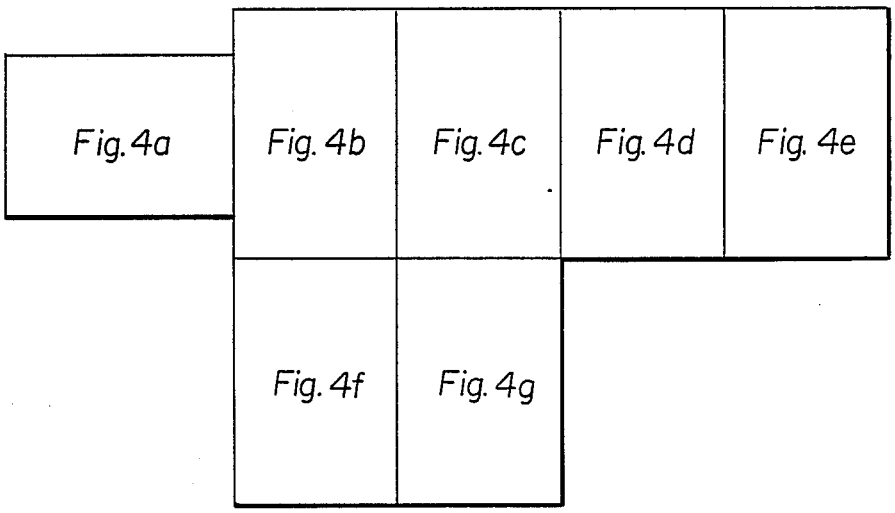
FIGS. 4 4A thru 4G are electrical schematics for the microprocessor, memory, power supply and power monitoring/reset portions of circuitry of an apparatus embodying the present invention.
Figure 5:
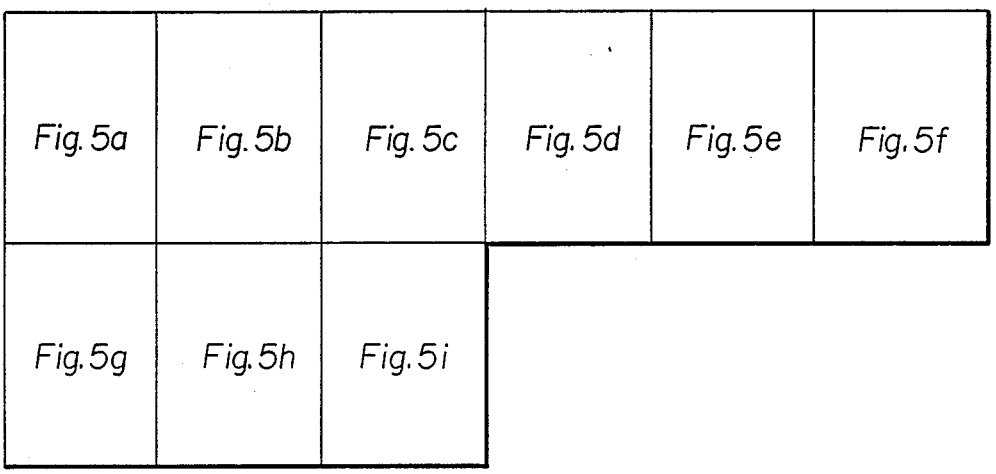
FIGS. 5 5A thru 5I are electrical schematics for the temperature and humidity sensor and aeration control circuitry of an apparatus embodying the present invention.
Figure 6:
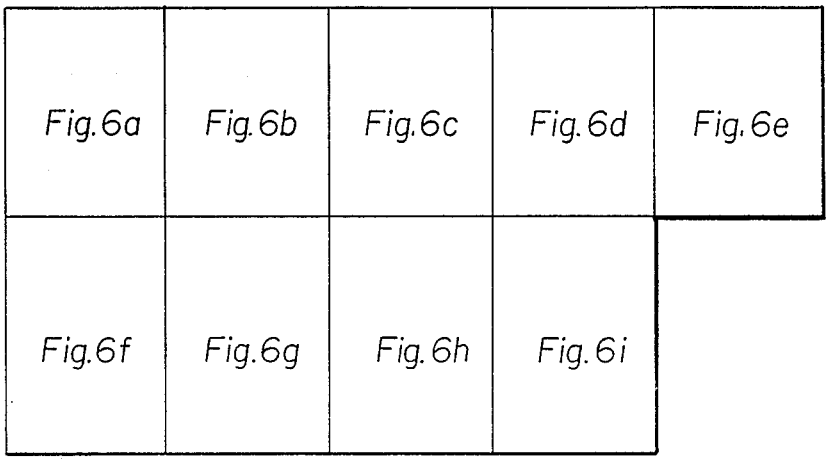
FIGS. 6 6A thru 6I are electrical schematics for the membrane keyboard input, display and display driver circuitry for an apparatus embodying the present invention.
Figure 4A:
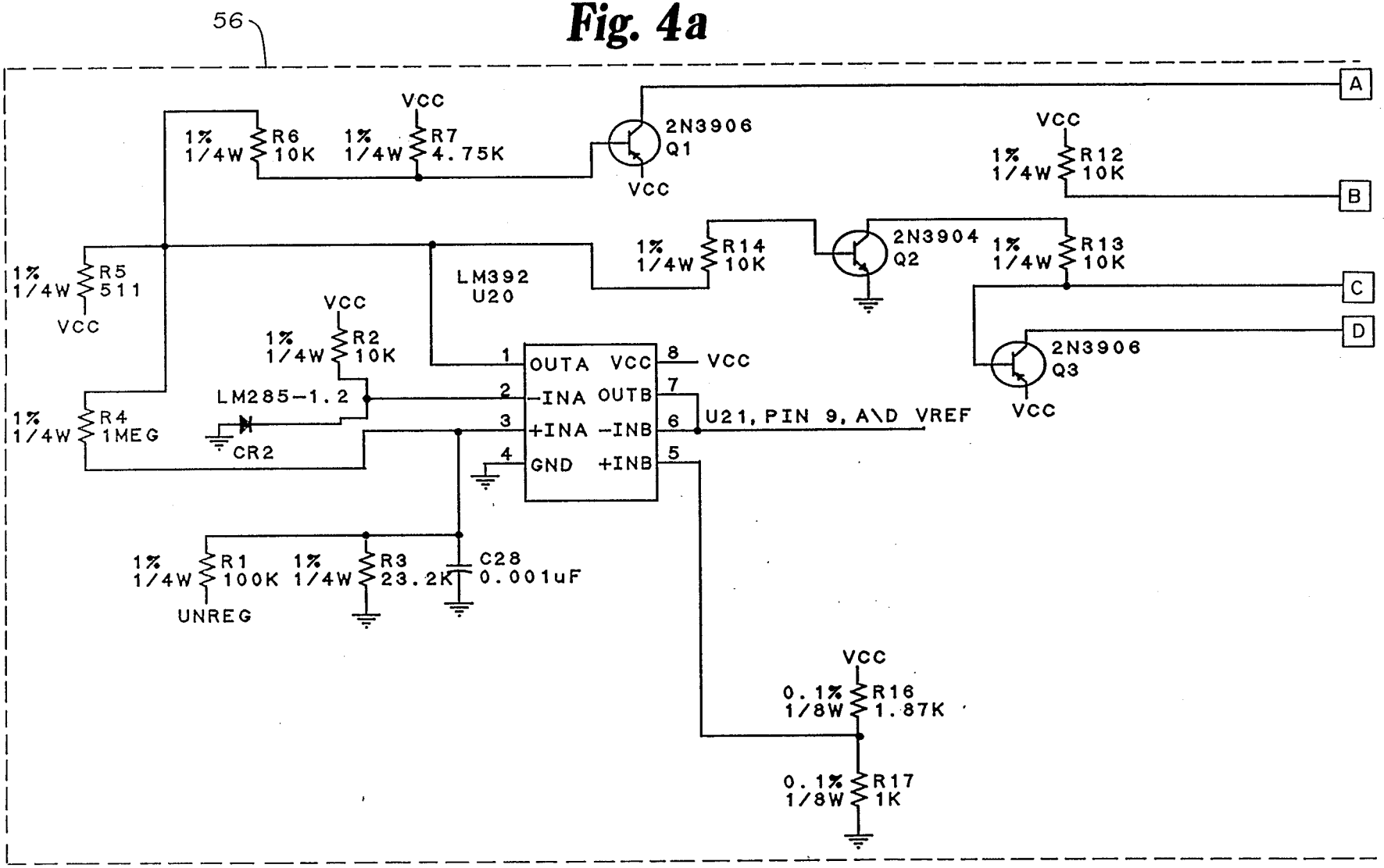
Figure 4B:
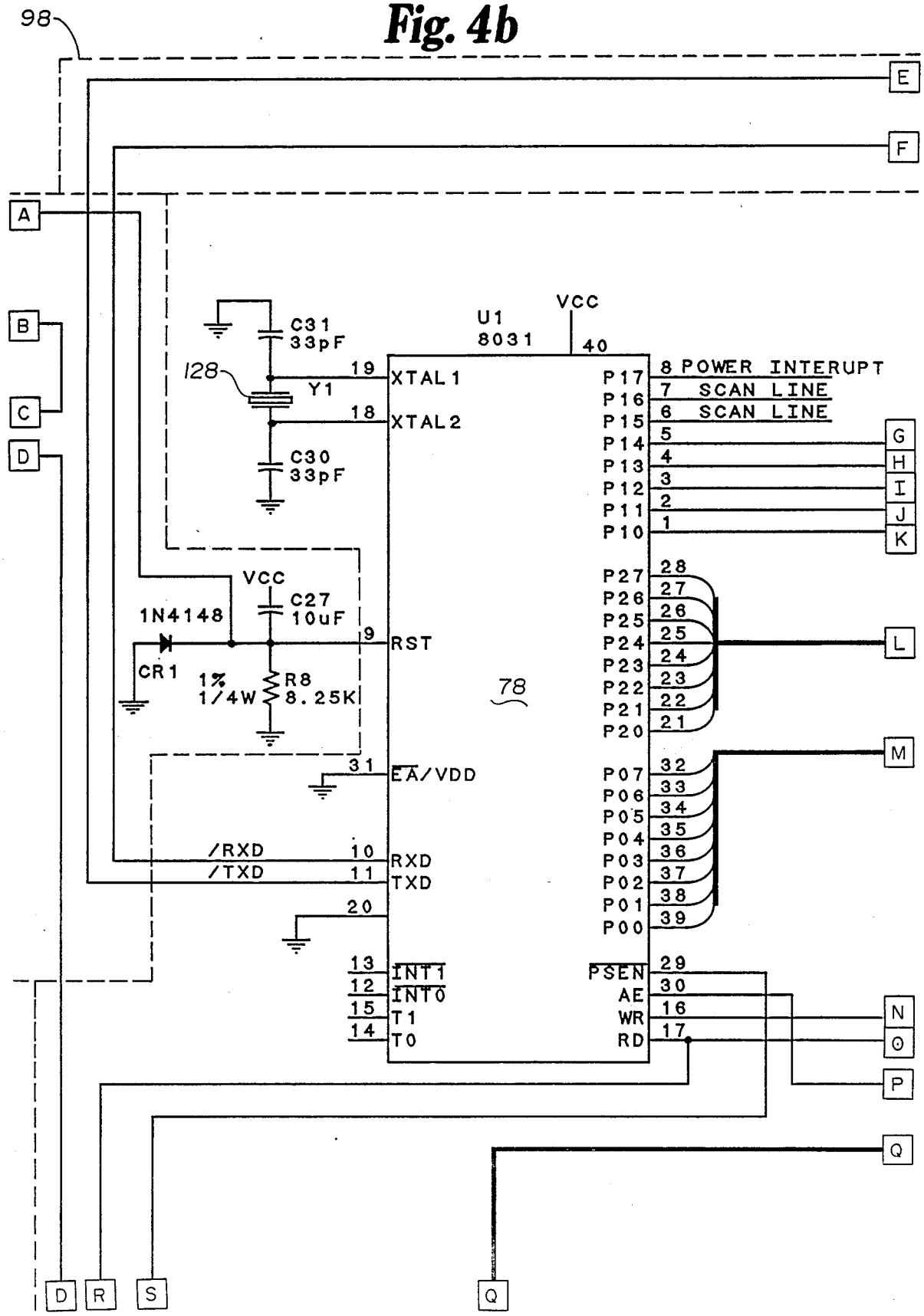
Figure 4C:
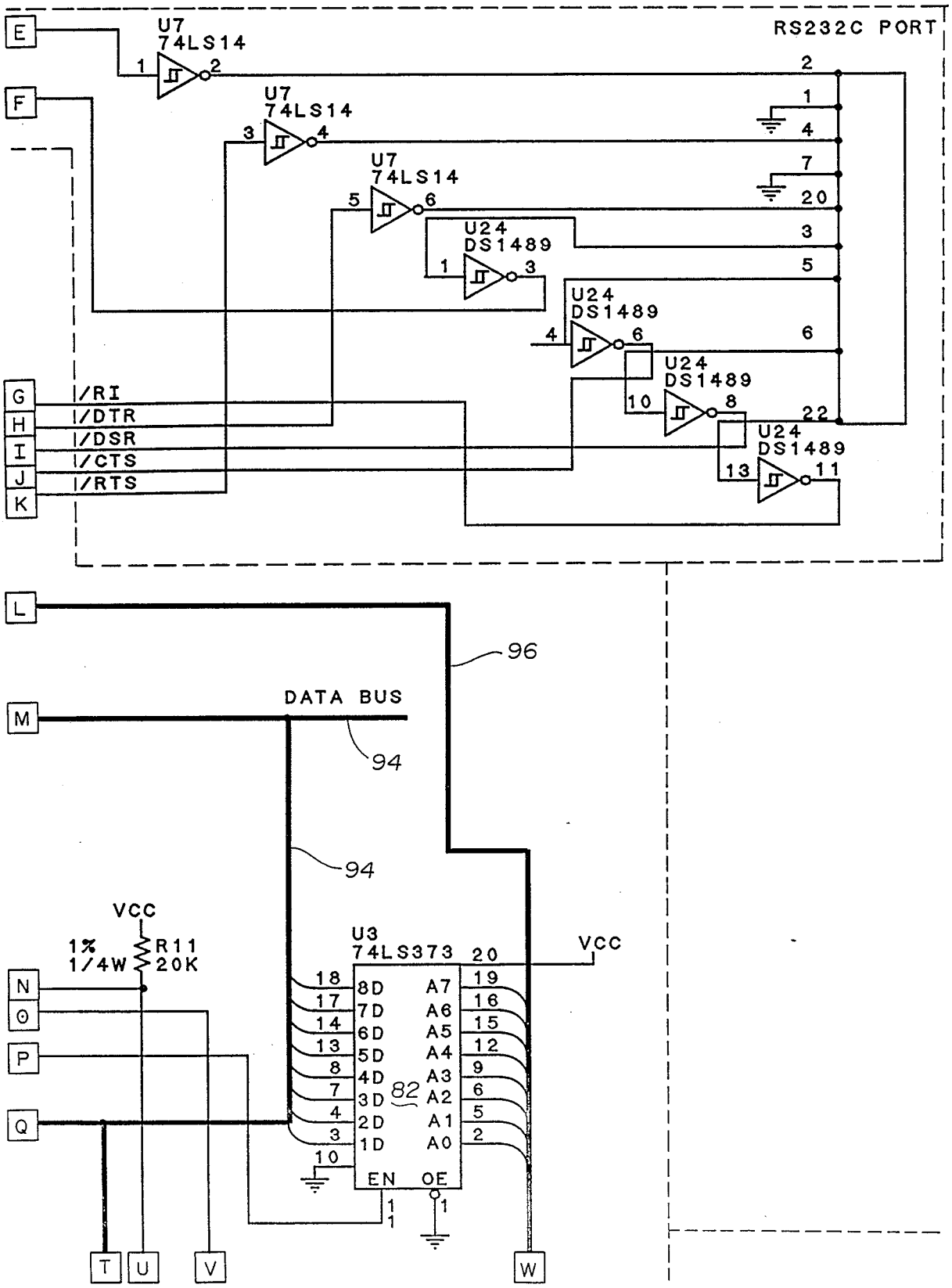
Figure 4D:
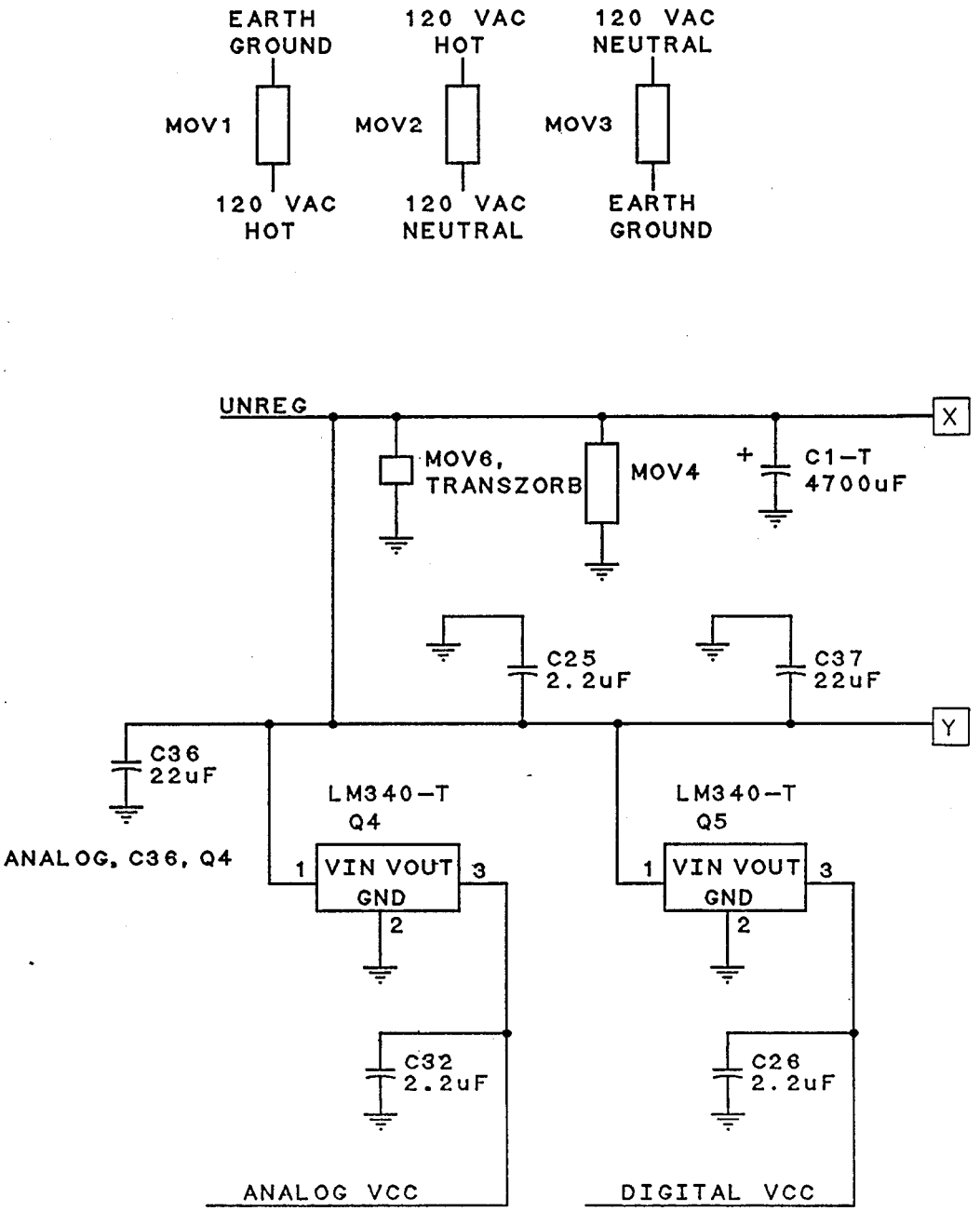
Figure 4E:
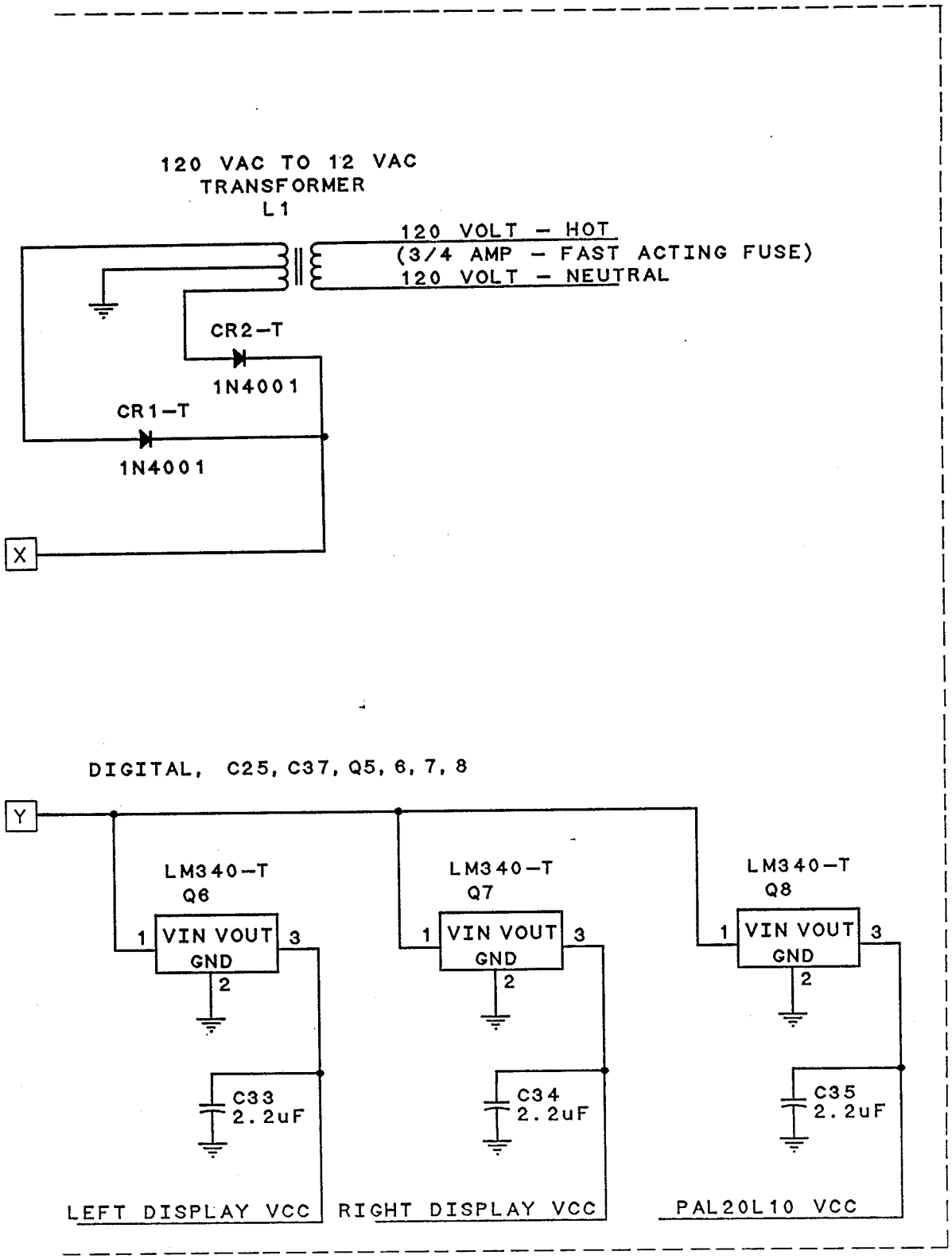
Figure 4F:
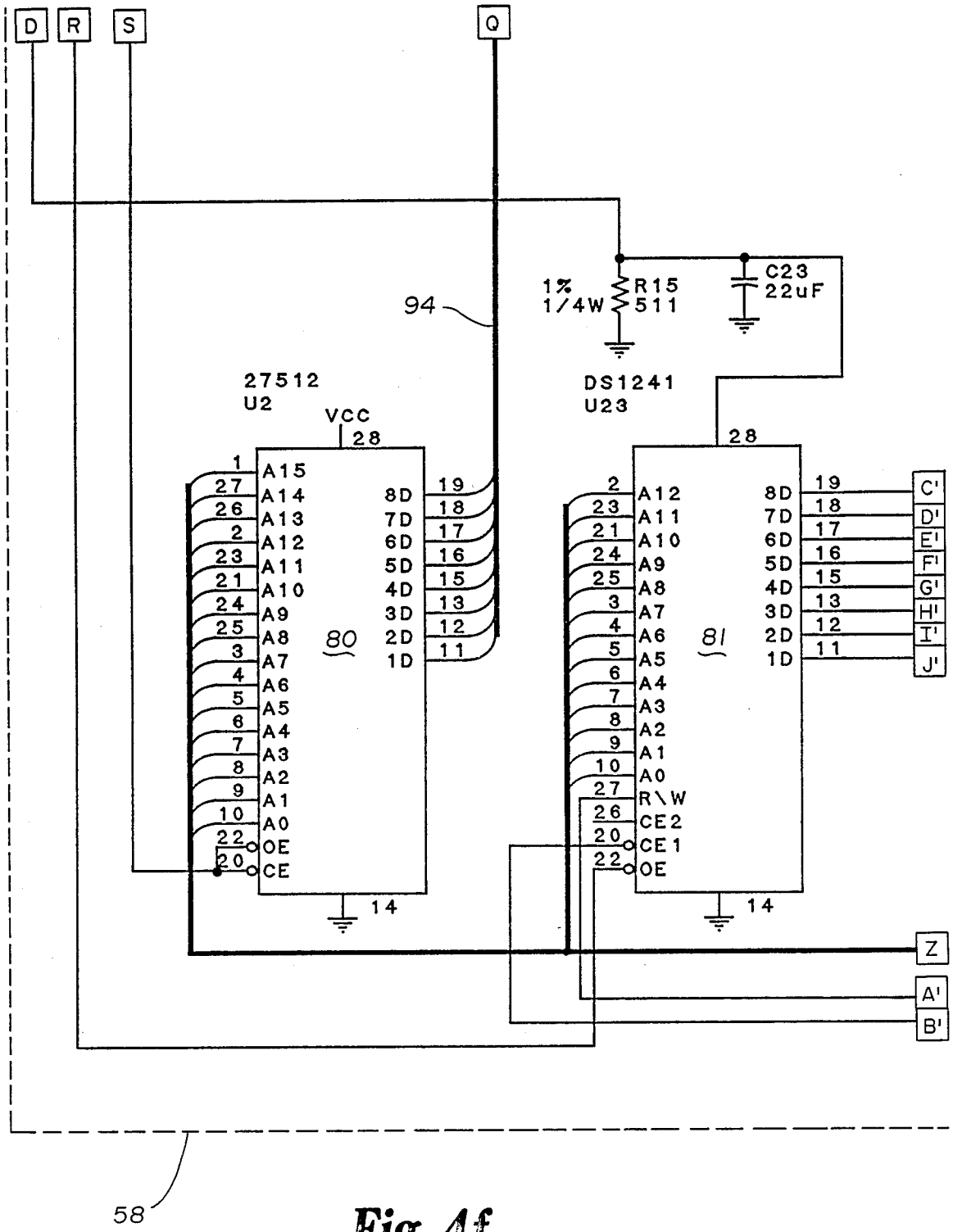
Figure 4G:
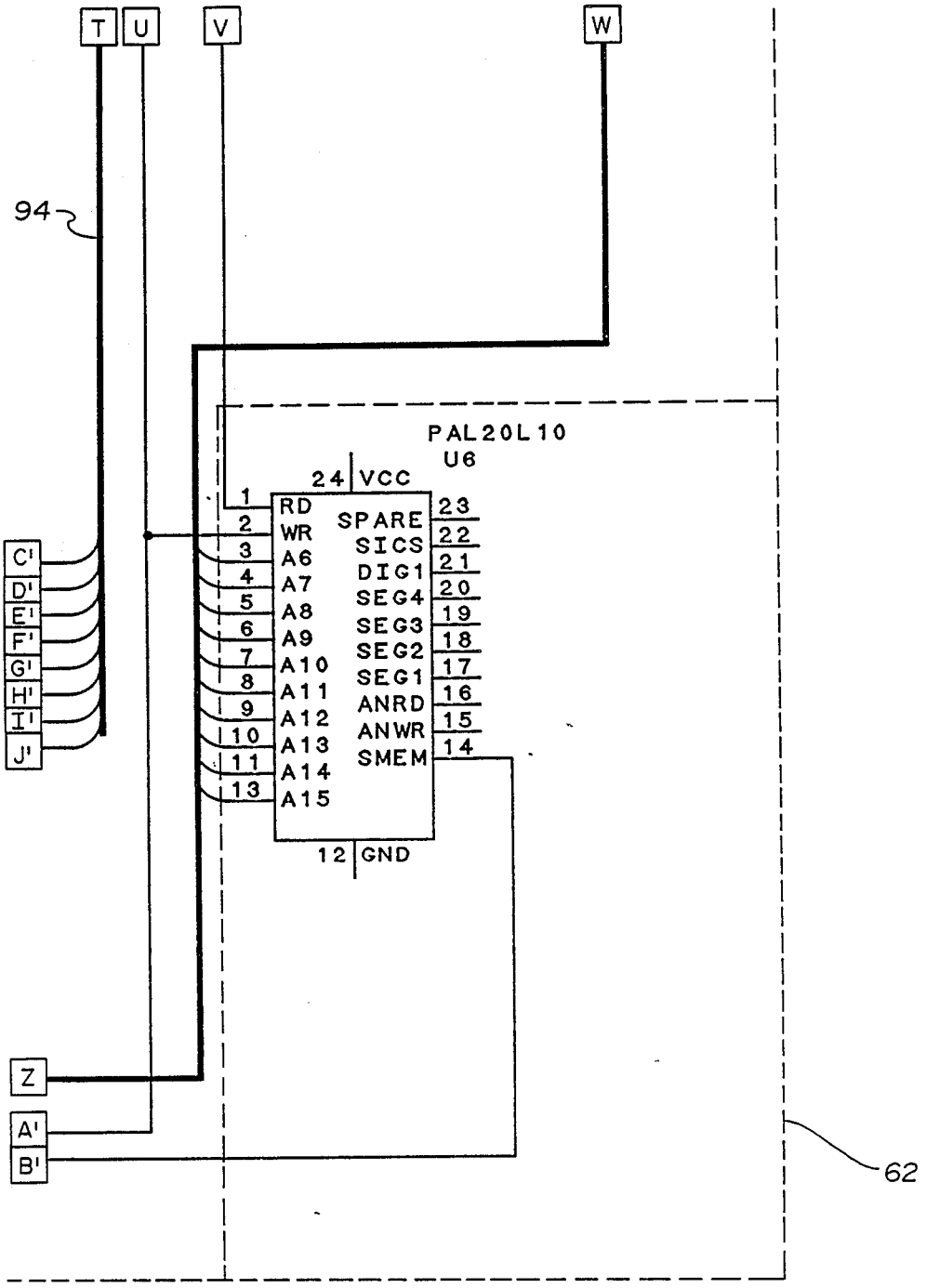
Figure 5A:
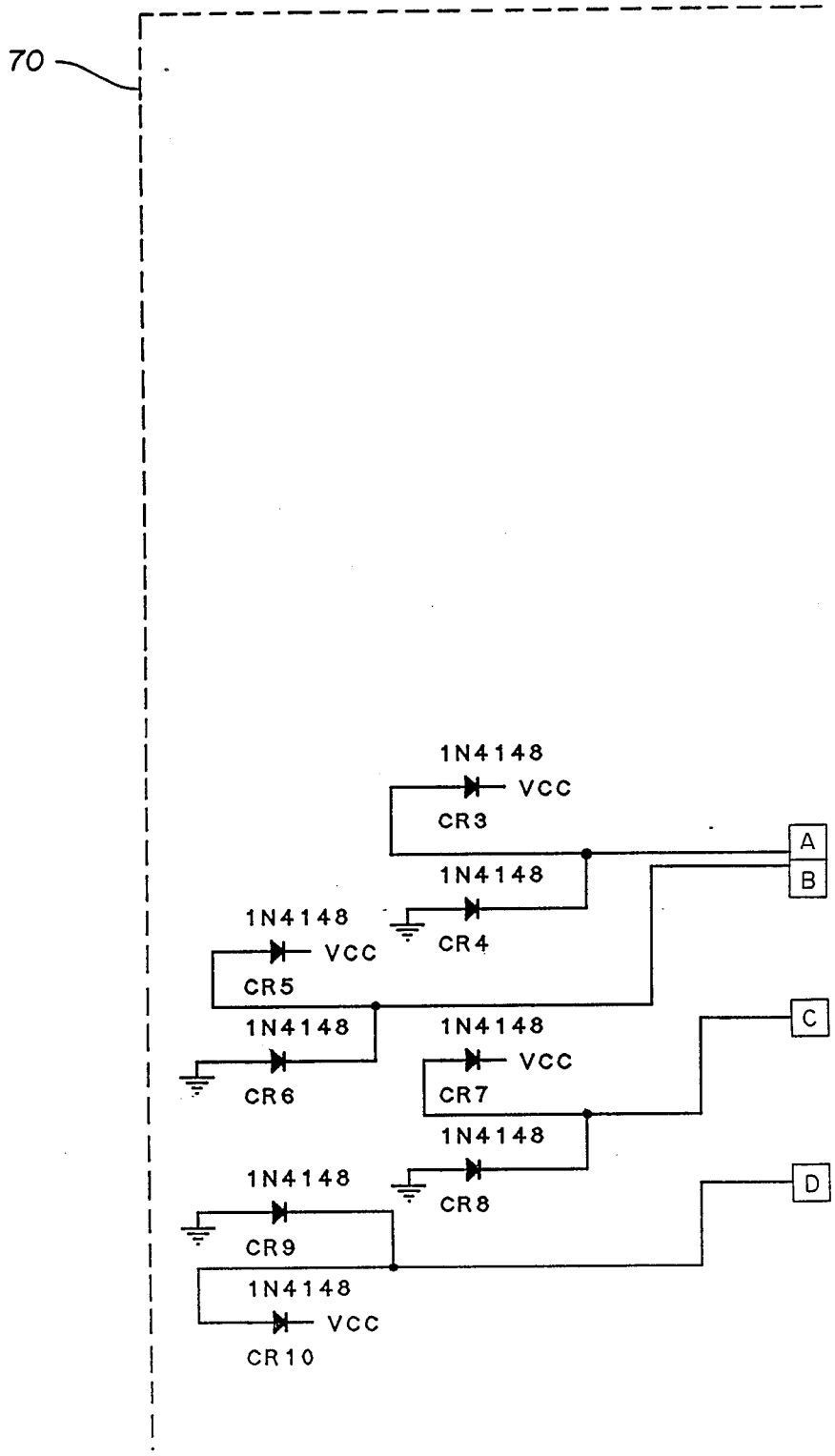
Figure 5B:
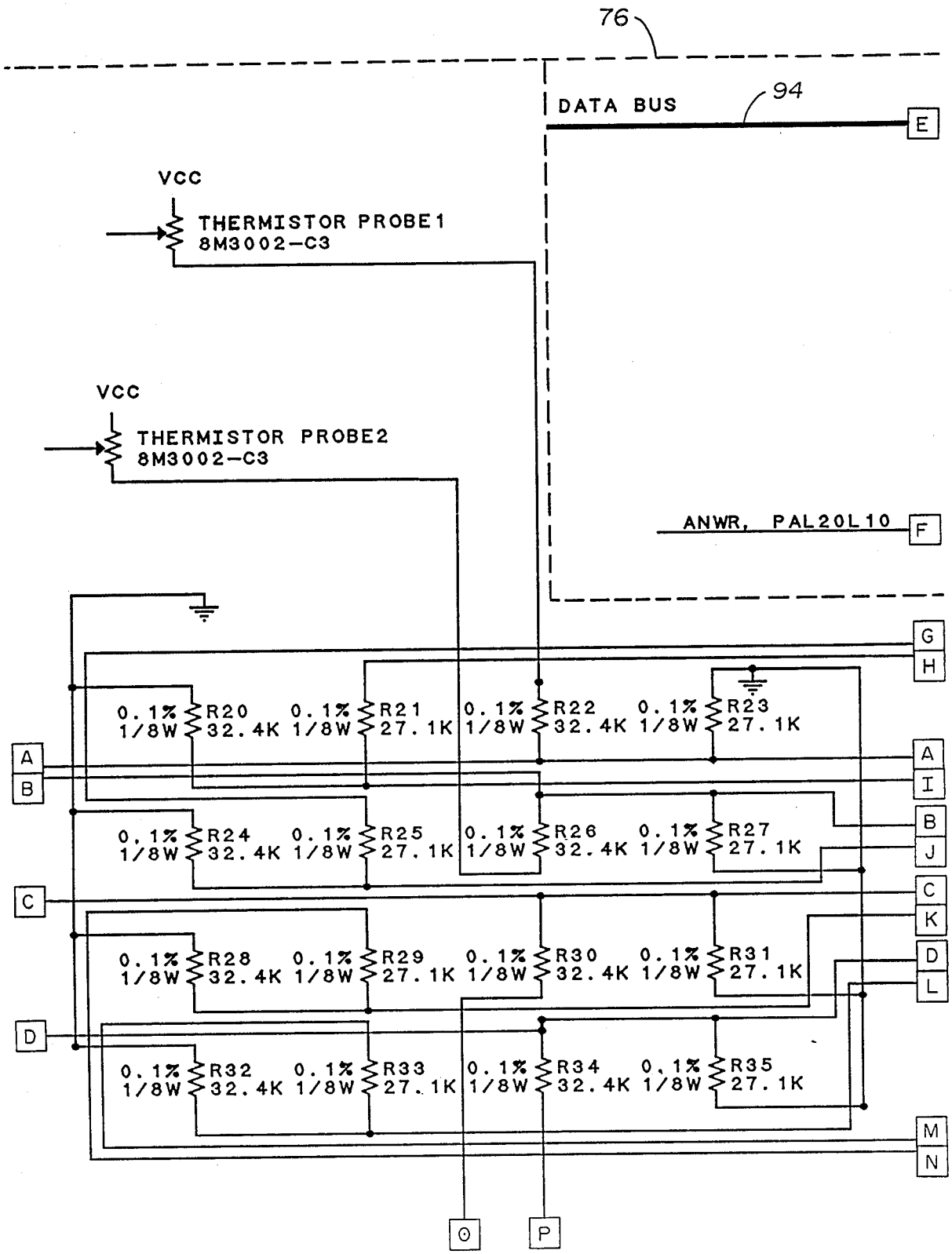
Figure 5C:
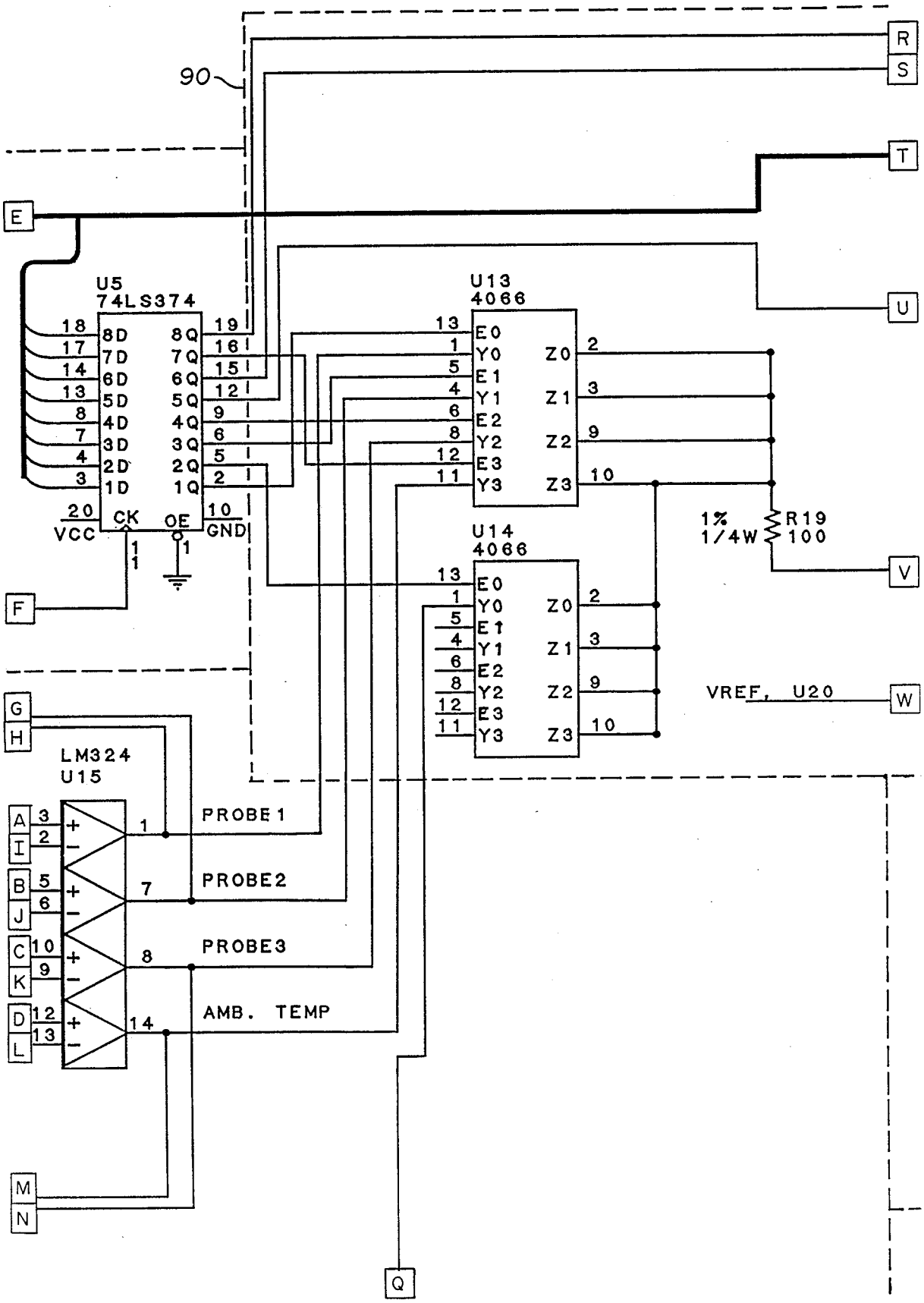
Figure 5D:
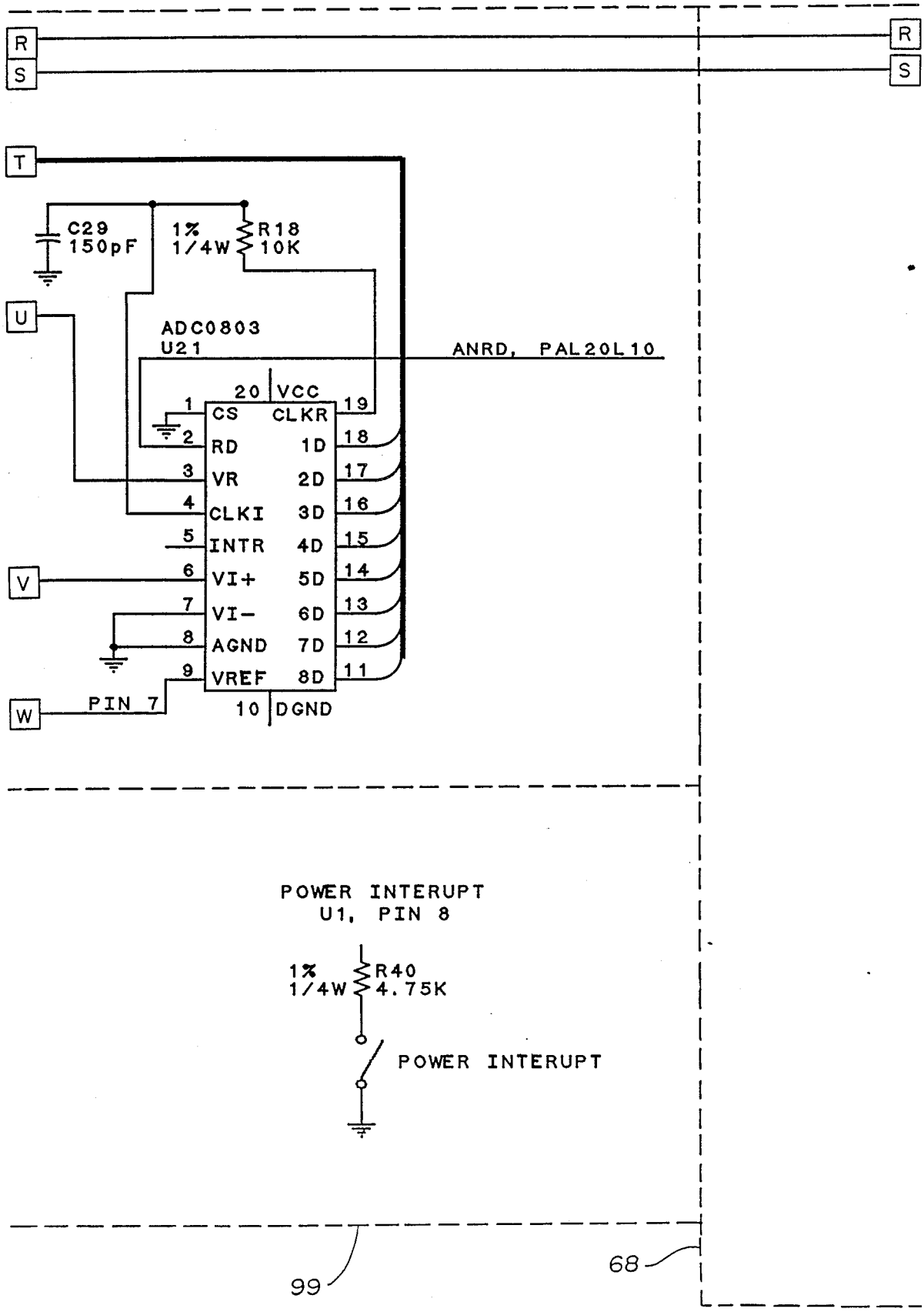
Figure 5E:
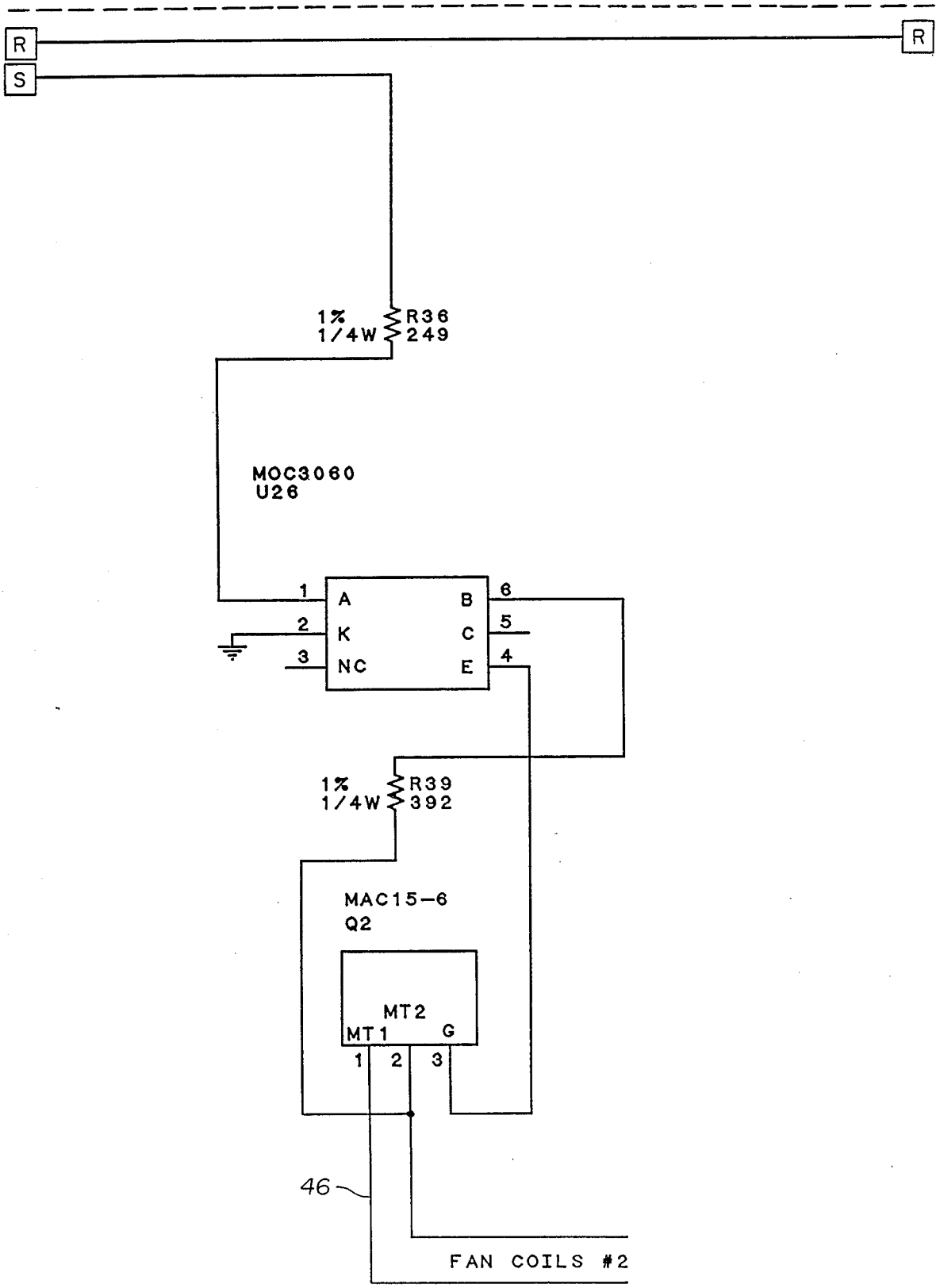
Figure 5F:
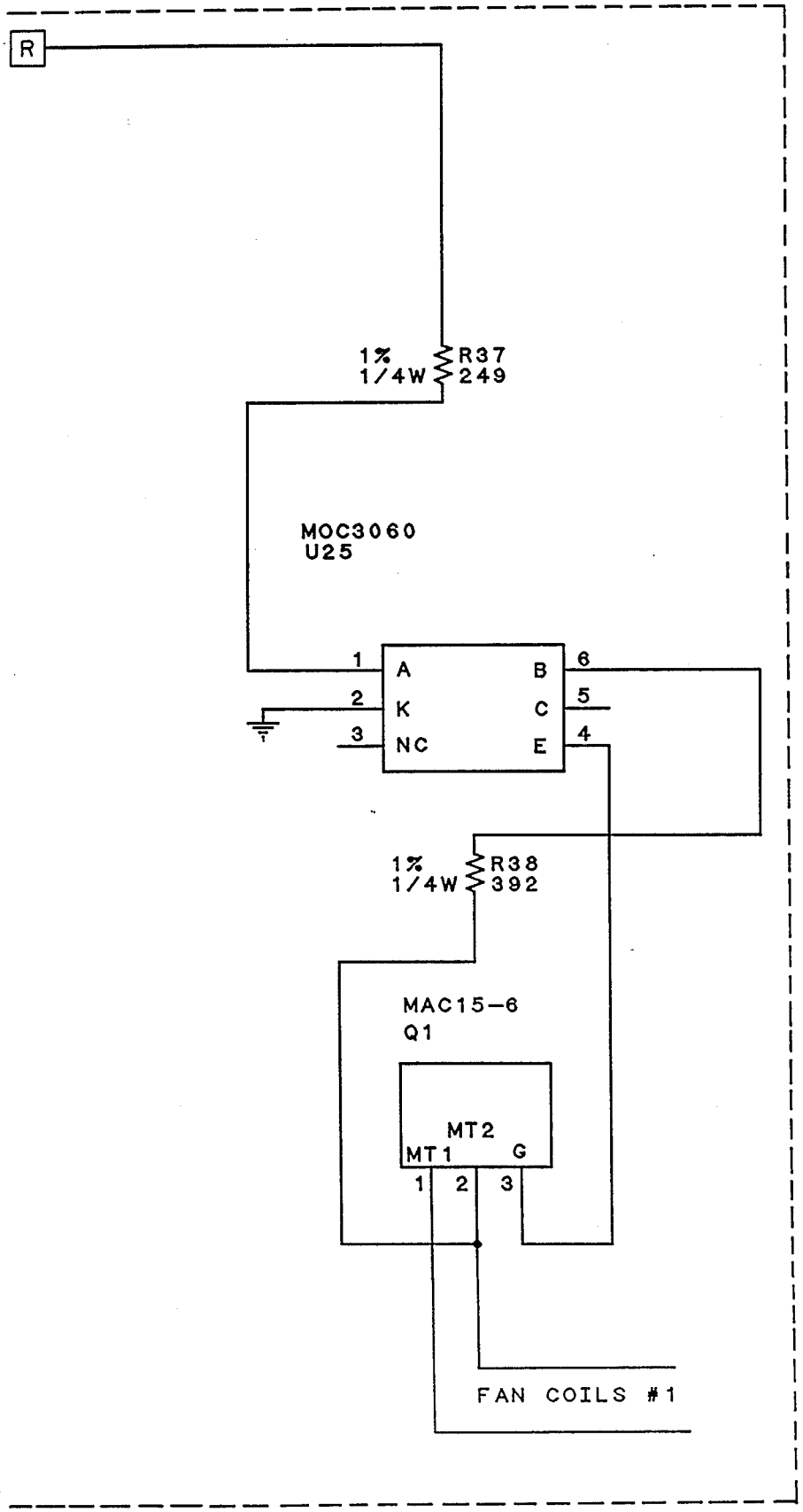
Figure 5G:
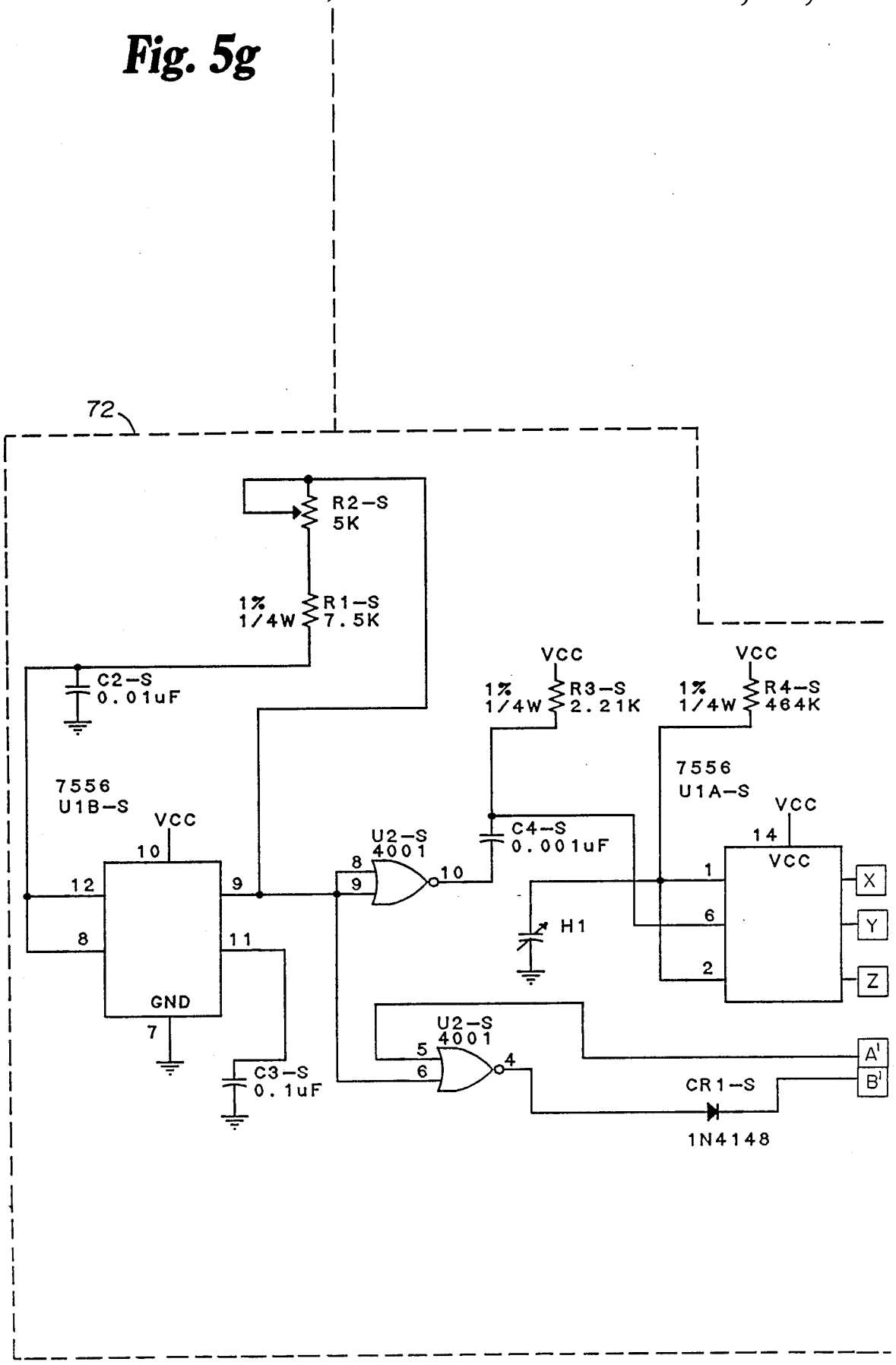
Figure 5H:
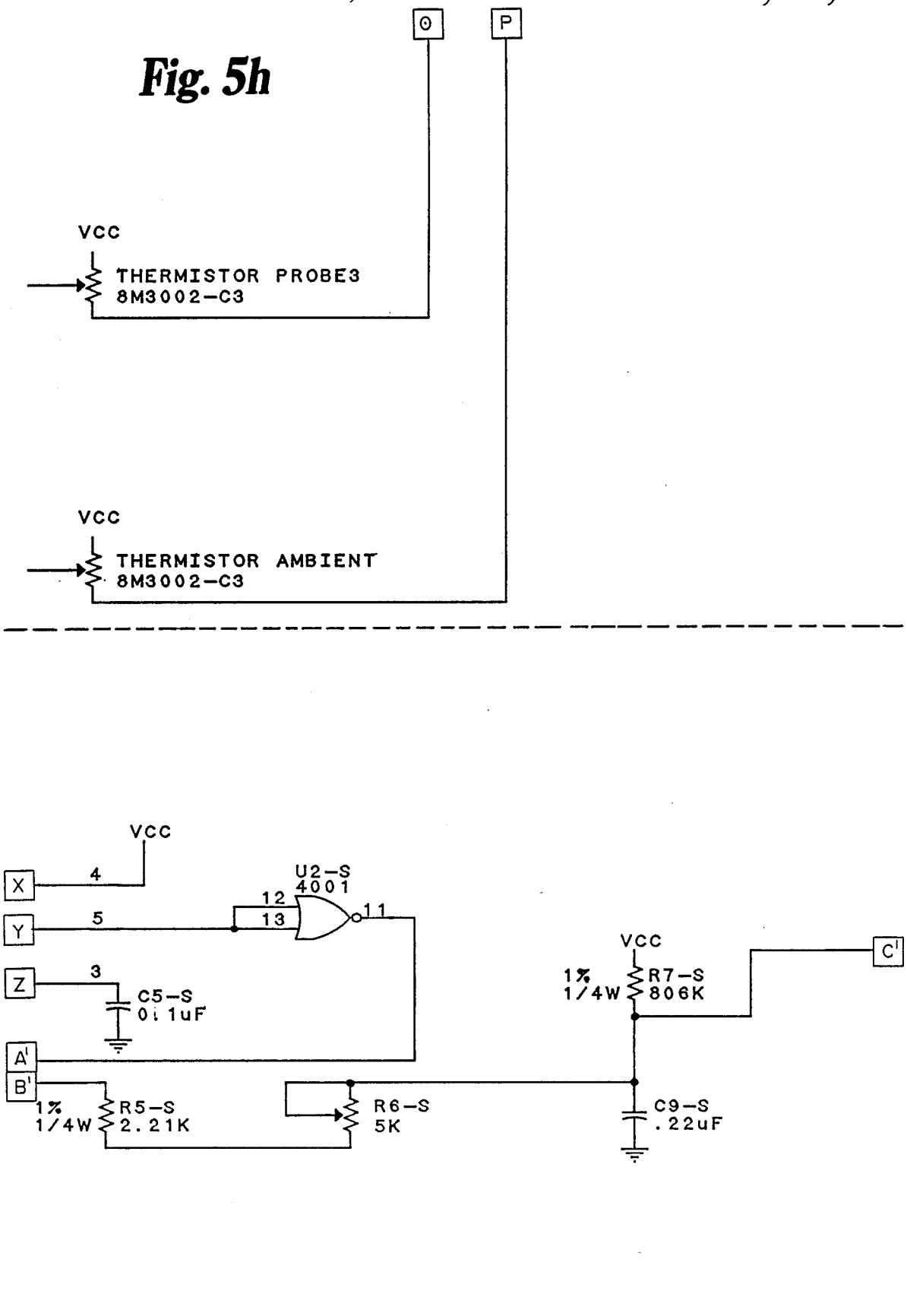
Figure 5I:
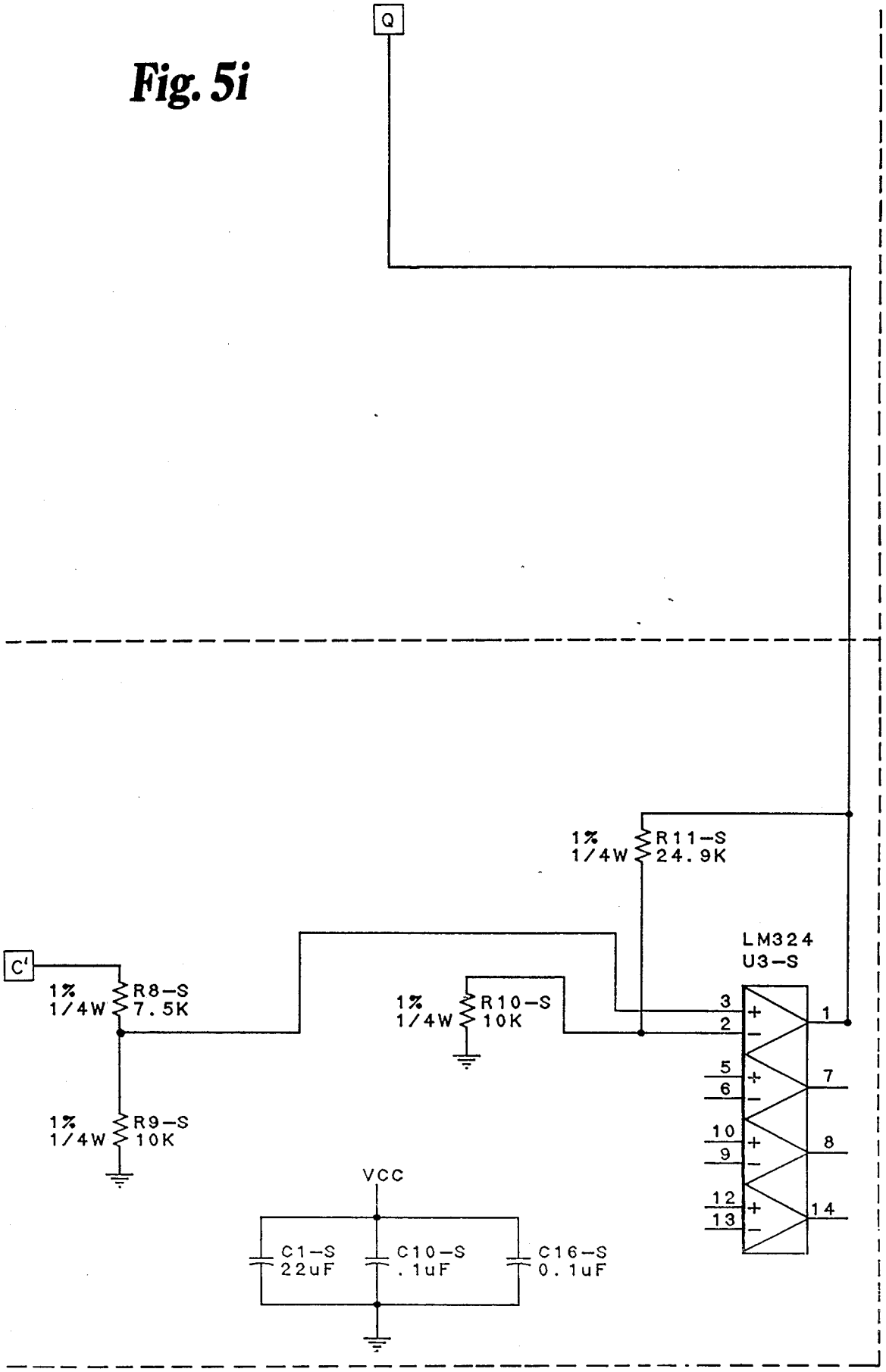
Figure 6A:
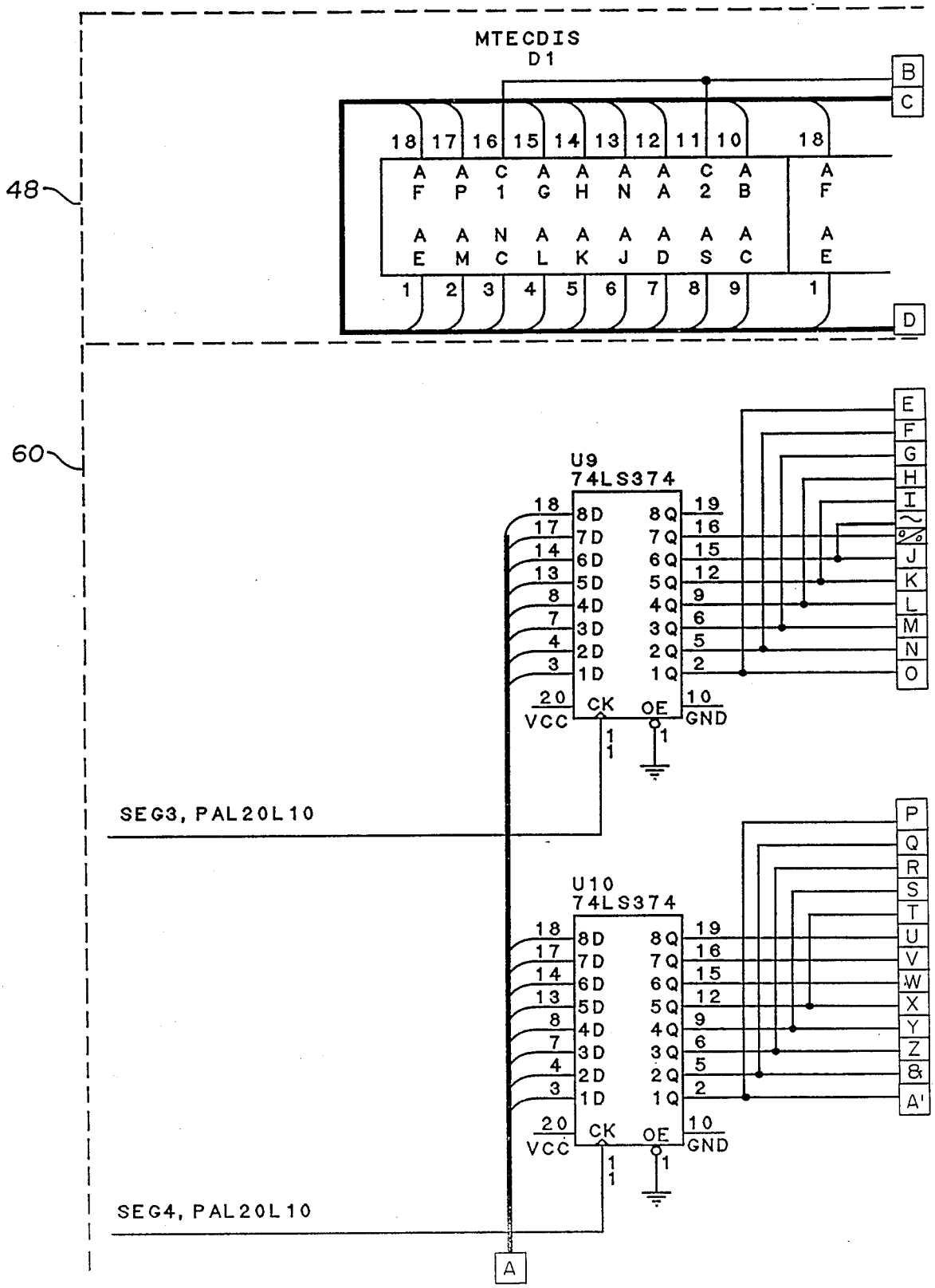
Figure 6B:
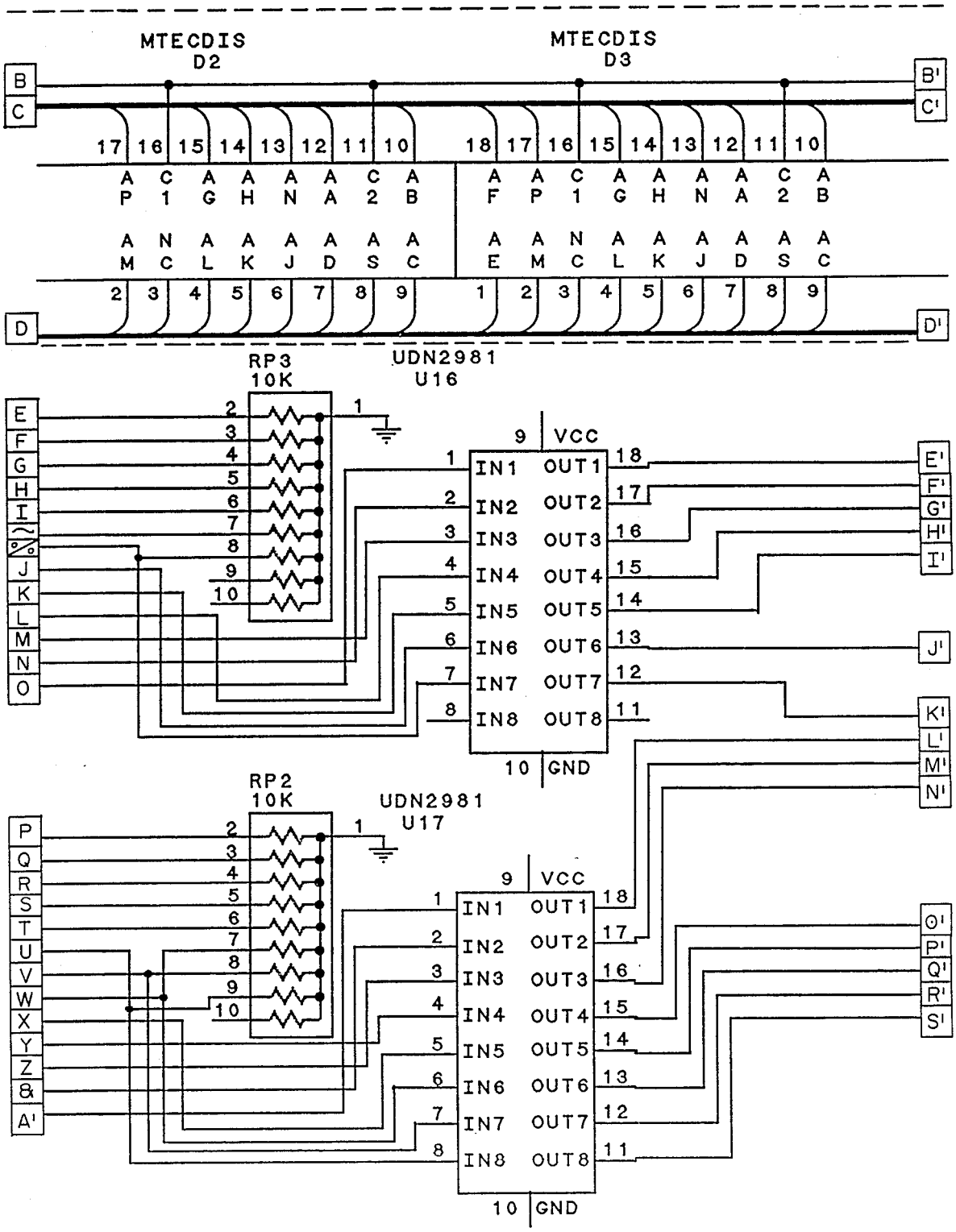
Figure 6C:
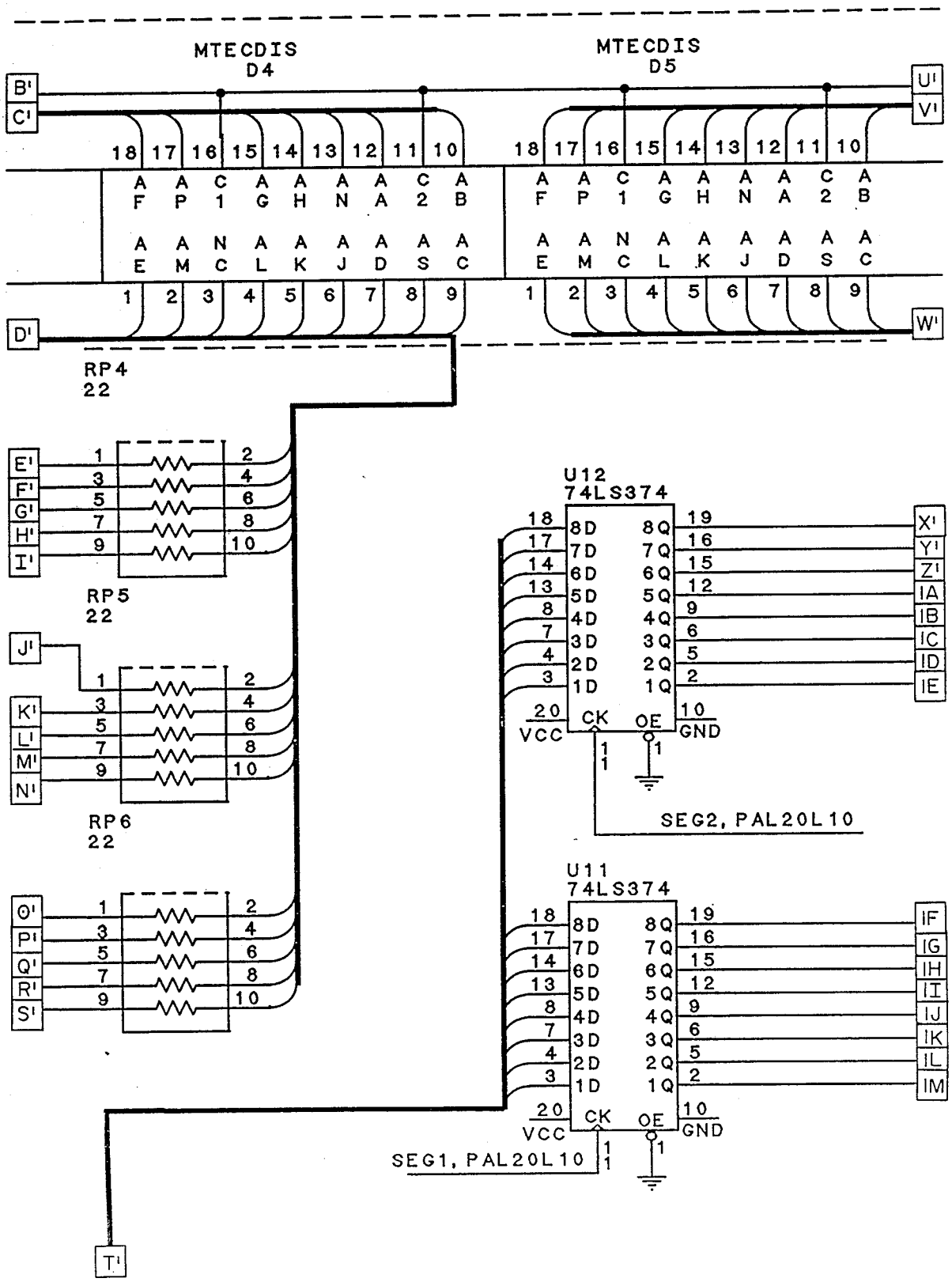
Figure 6D:
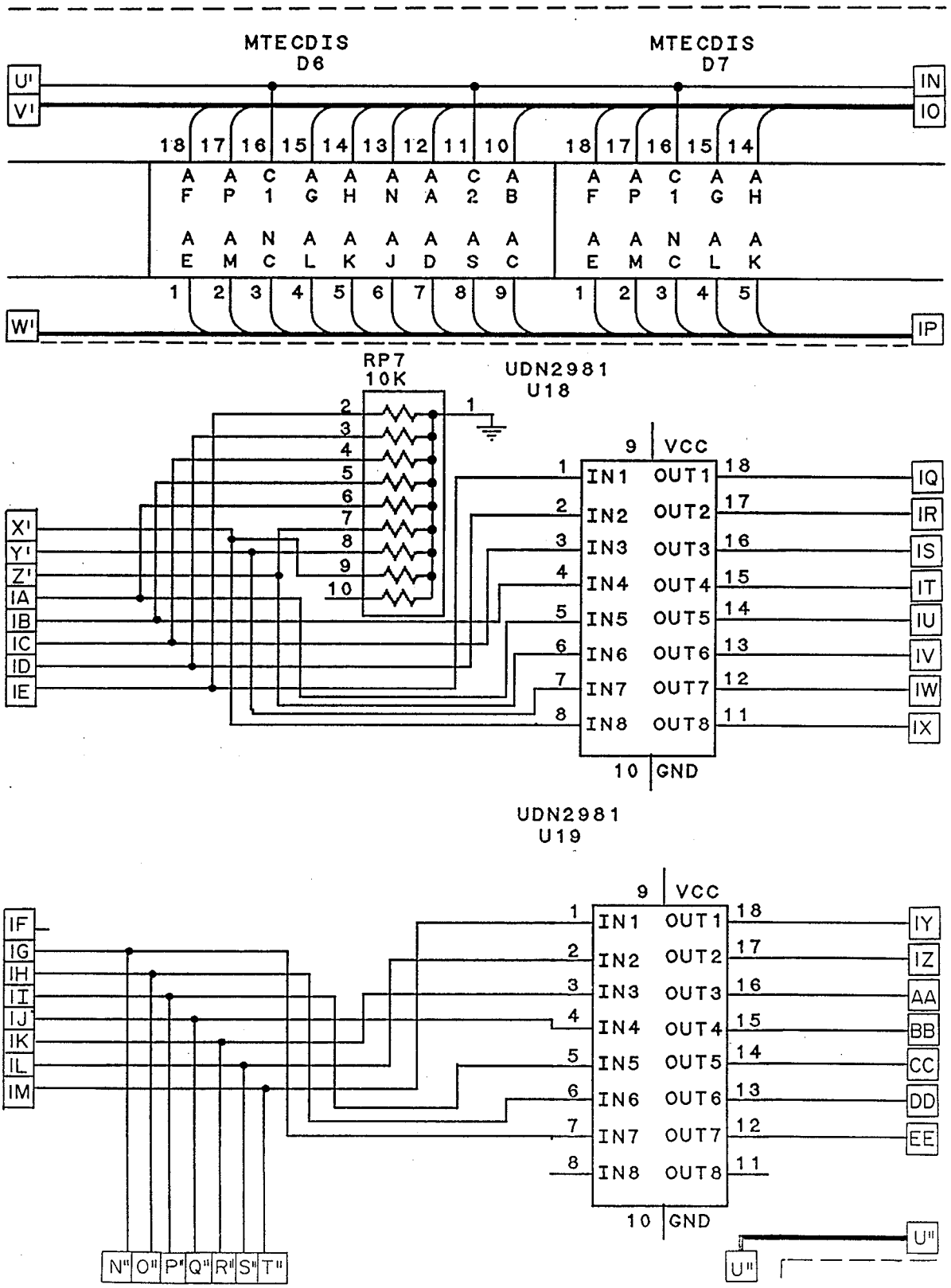
Figure 6E:
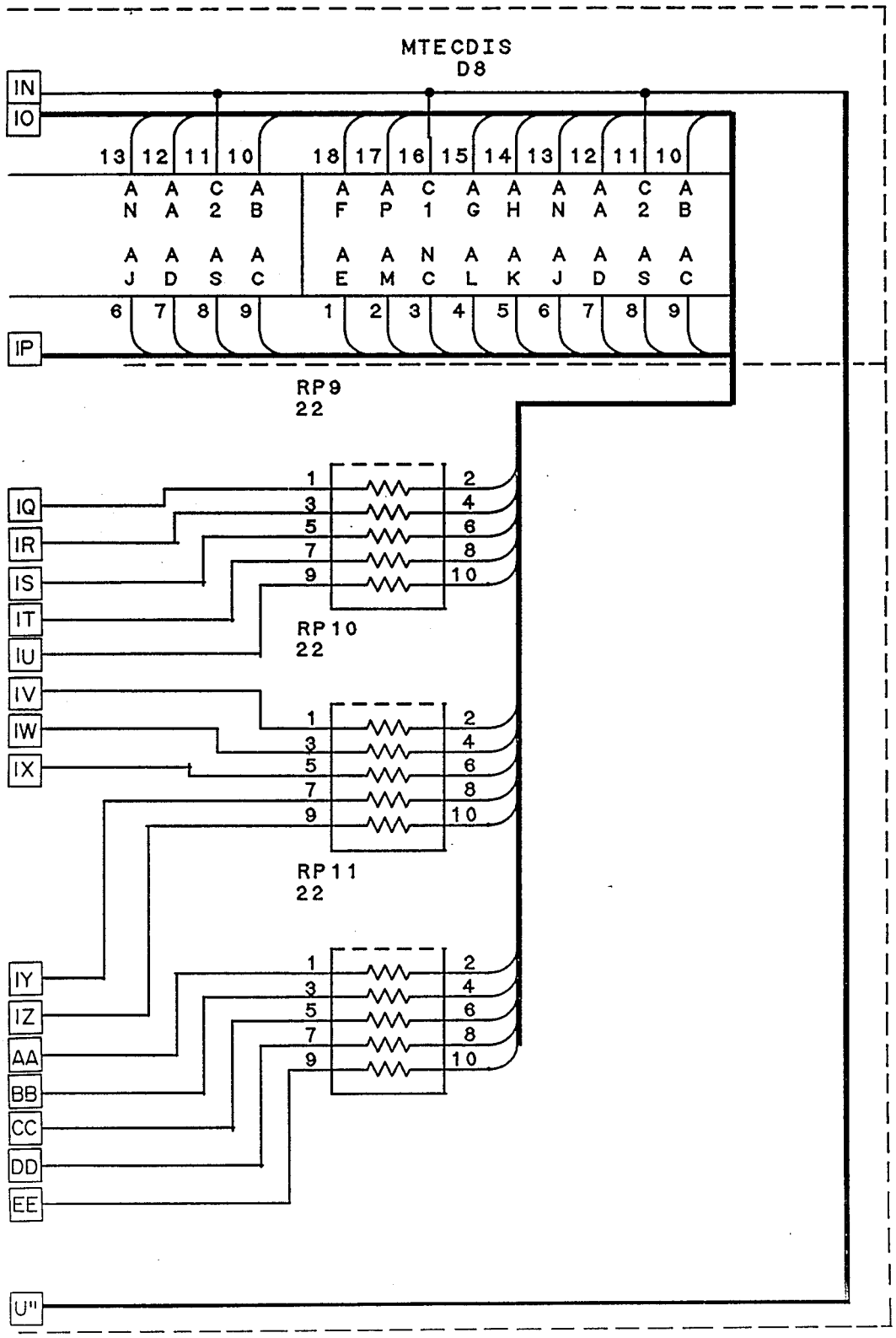
Figure 6F:
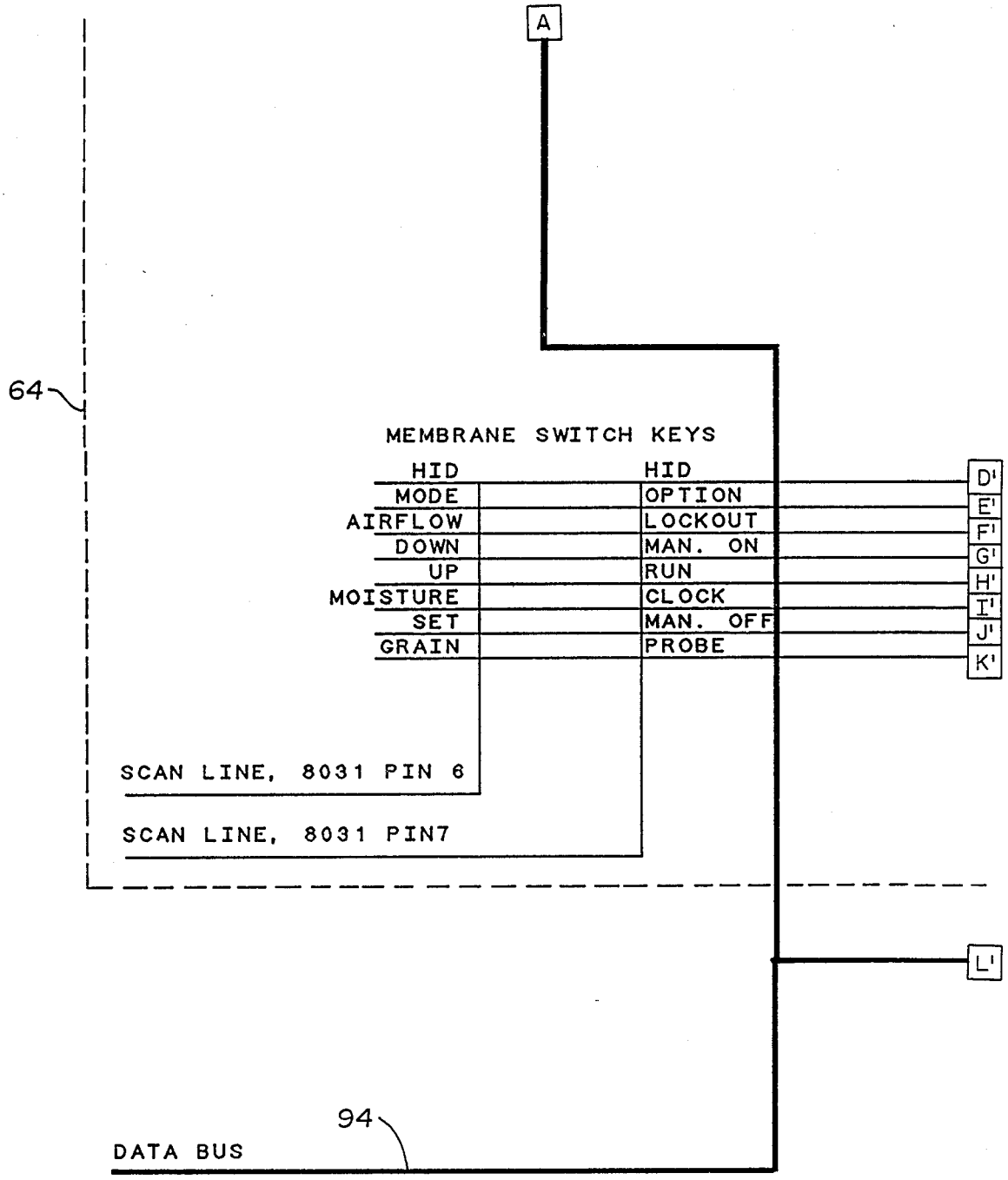
Figure 6G:
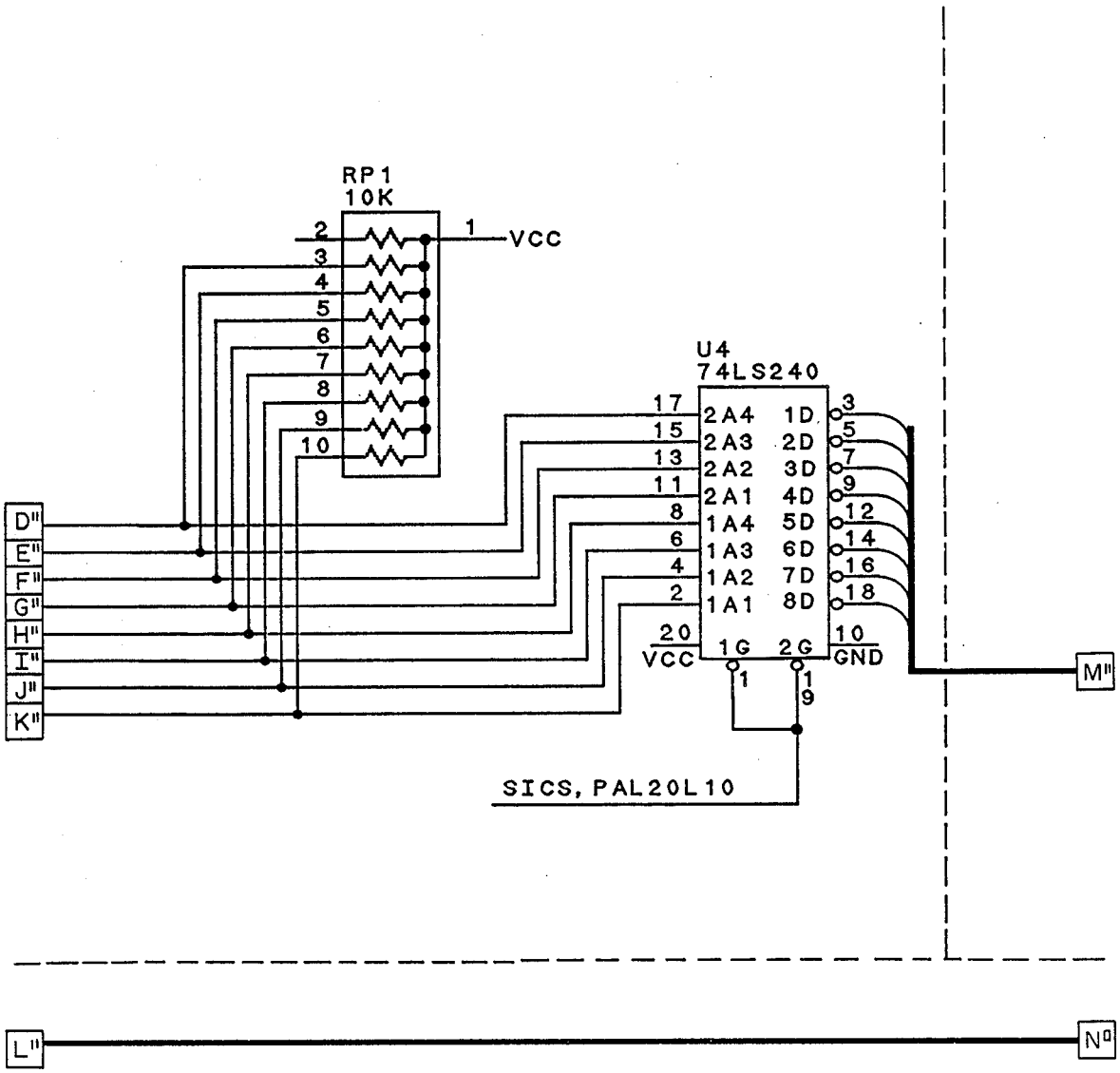
Figure 6H:
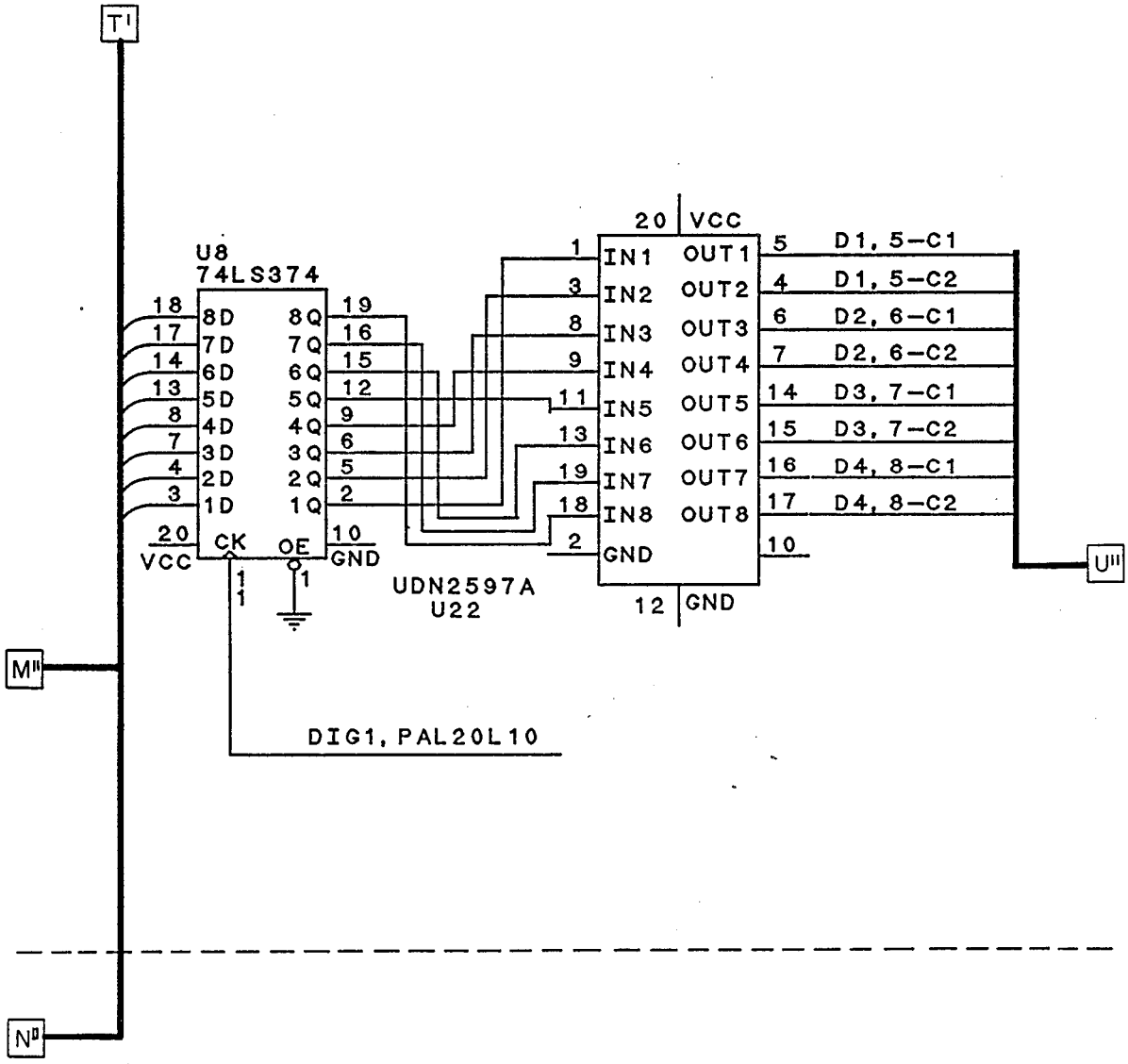
Figure 6I:
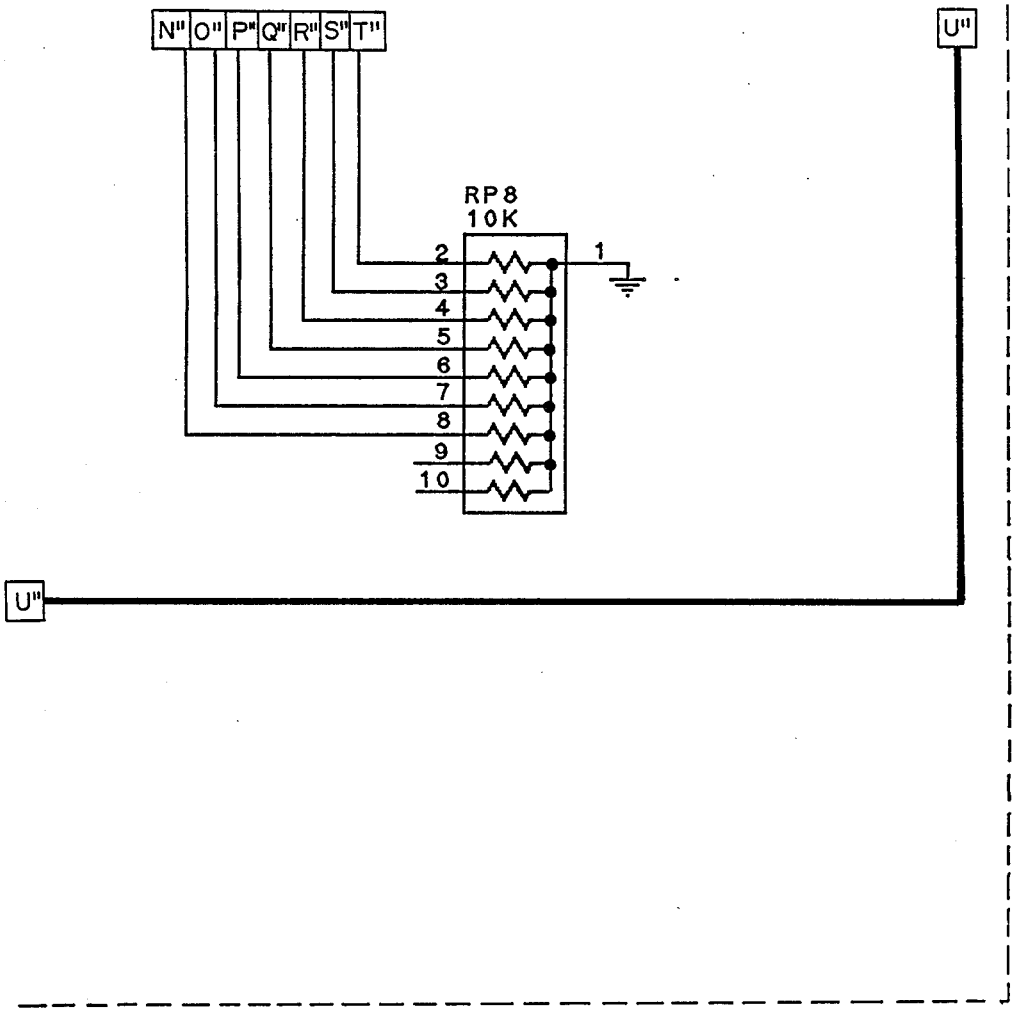

Referring now to FIGS. 4, 5 and 6, the electronic circuitry of the apparatus in accordance with the present invention will be described. In these figures individual chips are identified by standard model numbers. Numerals in the figures appearing outside the integrated circuit chips indicate actual pin numbers for the indicated types of integrated circuit chips. Reference numbers on electrical lines interconnecting the various integrated circuit chips will assume reference to the drawings for the proper pin connections.

The apparatus 10 for controlling the storage of grain broadly includes a power monitoring and reset circuit 56; a power supply 57 a processing unit 58; a display driver module 60 (associated with visual display 48); an I/O decoder module 62 for the processing unit 58; keyboard input switch circuit 64; fan actuating circuit 68; air and grain temperature sensing module 70; relative humidity sensing module 72; sensor data processing module 90 and an I/O selection switch circuit 76.

The power supply 57 receives standard 120 VAC line supply, reduces its voltage by a transformer L1 to 12 VAC, rectifies and smoothes it, regulates it using five 5-volt LM340-T power regulators (available from: National Semiconductor), and provides DC output voltage of 5 volts (VCC) at five different points. Also available is the unregulated output voltage after rectification (UNREG), for input to power monitoring and reset circuit 56. The S20K150 metal oxide varistors MOV-1-MOV3 (Siemens) are connected to the primary of transformer L1 to protect circuits from surges. V18ZA40 varistor MOV4 (General Electric) and 1.5KE27C Transzorb MOV6 (General Semiconductor) provide additional surge protection on the secondary side of L1.

The processing unit 58 includes a microprocessor (CPU) 78, a first memory unit 80 (EPROM), a second memory unit 81 (battery backed-up static RAM), and an address/data latch 82. The microprocessor 78 is advantageously a type 8031 unit (Intel). The EPROM memory unit 80 is advantageously a type 27512 chip (Toshiba) with 512K bit capacity, while the static RAM memory unit is advantageously a DS 1241 chip (Dallas Semiconductors) with 8K by 8 bit capacity (and a real-time clock). The latch 82 is advantageously a type 74LS373 chip (Fairchild).

Lines P00 through P07 and P20 through P27 comprise addressing lines interconnecting the CPU 78 with EPROM 80, PAL20L10 U6 and RAM 81. Lines P00 through P07 also serve as data lines for bringing data to the CPU 78 (via the microprocessor data bus 94) from the EPROM 80 or the RAM 81. The latch 82 is used to place the address data from lines P00 through P07 of the CPU 78 on the system address bus 96 under control of the AE (address latch enable) line of CPU 78. Basically, the CPU 78 addresses the EPROM 80 to fetch program instructions for execution. The CPU 78 also reads data from or writes data into the RAM 81. Data to be displayed by the display module 60 are communicated out on microprocessor data bus 94.

Clock crystal 128 provides clocking pulses at 6 MHz for operation of the CPU 78. Supply voltage (VCC) at 5 volts, is provided to the CPU 78 at pin 40. Power monitoring and reset circuit 56 provides a power condition reset control to CPU 78 at pin 9 and also turns power on and off to RAM 81 according to appropriate power conditions. This circuit also provides VREF reference voltage for the A-to-D converter in the sensor data processing module 90. An LM392 dual op-amp/comparator (National Semiconductor) is the primary chip in this circuit.

A PAL 20L10 National Semiconductor programmable array logic chip serves as an I/O decoder module 62 connected to the A6–A15 addressing lines and to the write (WR) and read (RD) lines of the CPU 78. The PAL 20L10 chip (U6) is a customizable device which is programmed in the present invention to decode address information from the CPU 78 for selecting the different I/O points and devices that provide operating parameters to or receive data from the processing unit 58. Addresses provided on lines A6–A15 cause various I/O points and devices to be selected, as represented by the outputs on the right hand side of the chip. Selection of the SICS (switch input chip select) line connected to the 72LS240 (Fairchild) octal buffer U4 of the keyboard input switch circuit causes the output from the 14 visible and two hidden keyboard switches **50*a*–50*j*; 51*a*–51*c*, 52*a*–52*c* to be placed on the data bus 94. Two scan lines from P15,P16 of the CPU 78 cause the output from half of the keyboard switches to be alternately polled and placed in the octal buffer. Selection of the ANWR (analog write) line connected to the 74LS374 (Fairchild) I/O switch latch U4 in the I/O selection switch circuit 76 causes the 4066 CMOS switches (National Semiconductor) to select analog sensor voltage from the air and grain temperature sensing module 70 or the relative humidity sensor circuit 72 to be inputted to the ADC0803 analog to digital converter (National Semiconductors). Coordinated selection of the ANRD line initiates the A-to-D conversion and places the digital sensor data on the data bus 94. Selection of the ANWR line also signals that the I/O selection switch circuit 76 will receive data causing it to deliver control signals to the fan actuating circuit 68**.

Selection of the DIG 1 or SEG 1 to SEG 4 lines connected to the display driver 60 signals that the display 60 is to receive data on the microprocessor data bus 94. Selection of the SMEM (static memory) line connected to the RAM 81 enables the RAM 81 to place or receive data on lines 1D–8D using the data bus 94. In sum, by programming the I/O decoder module 62 to select various lines on its right-hand side based on the inputs received at its left-hand side under coordination of the CPU 78, the various I/O devices associated with the processing unit 58 can be individually selected.

The keyboard input switch circuit 64 is, as noted above, connected to and polled by two scan lines of the CPU 78. When the I/O decoder module 62 selects line SICS, the eight switch states corresponding to the one active scan line willl be communicated to the processing unit 58 on the data bus 94 via the 74LS240 (Fairchild) octal buffer U4. In this way the CPU 78 can be directed by any of the 14 visible and two hidden keys on the control panel 33. Functionally speaking, the various membrane switch input keys **50*a*–50*j* at the left side of the control panel 33 direct the CPU 78 to find the menu corresponding to the key most recently closed and to display the current selection from that menu. Depressing the upward or downward pointing arrow keys 51*b*–51*c* adjacent to the SET key 51*a* causes the CPU 78 to scroll through on the display 48 the options (if any) comprising the menu associated with particular input keys (discussed next). Scrolling occurs only when either the upward or downward pointing arrow is depressed. The SET key 51*a* is used to designate to the processing unit 58 selection of the parameter shown on the display 48** or to reach submenus when a multipart parameter is to be selected.

The keyboard input switch circuit 64 permits viewing and selection of the menus listed below:

GRAIN—use of scrolling arrows causes available grain types to be scrolled through on the display 48 (total of 17 different grains);

MOISTURE—use of scrolling arrows causes desired grain moisture content values from 8% to 18% to be scrolled through in 0.1% increments;

AIRFLOW—use of scrolling arrows, causes a menu of daily fan operation times to be scrolled through, from one quarter hour to twenty hours in quarter hour increments; where the time corresponds to a recommended time for a given air flow in cubic feet per minute per bushel (cfm/bu), the cfm/bu value accompanies the time, e.g., 4 hrs. 1/10 cfm/bu.

MODE—use of scrolling arrows causes the 15 operational modes (STORAGE 1–3, REWETTING 1–5, DRYING 1–5, SPECIAL 1–2) to be scrolled through;

PROBE—use of scrolling arrows causes Probe 1, 2 or 3 to be displayed so that probe 1, 2 or 3 can then be turned on or off.

CLOCK—permits setting the battery backed real-time clock to a specified time of day and day of week; a decimal point is used to designate the time or day element currently being scrolled through and set, using a display in this format: .DAY.HR.MIN-.AM/PM.

LOCK OUTS—permits aeration to be inhibited during certain time periods on selected days of the week; after the affected bin is selected, a start time and an end time for the inhibition period is selected as with CLOCK above, then days are selected to which the defined inhibition period applies; any time period can be selected for inhibition for either bin on any day; up to three such time periods per bin can be defined. (This is used mainly to stagger load or avoid running fans when power rates are highest or when fan noise would be disruptive.)

OPTIONS—permits the following to be selected, using various submenus:

upper and lower limits for the temperature range centerpoint of the aeration band;

selection of lower temperature limit for wetting/drying modes;

speed of automatic display scrolling in RUN, MANUAL ON and MANUAL OFF modes;

select time delay between separate fan start ups;

display of a troubleshooting telephone number;

selection of Centigrade (C.) or Fahrenheit (F.) operation;

manual setting of a fixed additional offset for the acceptable temperature range for fall cooling;

access to diagnostic routines;

assignment of probes to bin 1 or 2;

zero counters of accumulated aeration time or reset entire control system;

manual setting of amount of "banked" aeration time and short term average temperature;

set ranges defining SPECIAL modes; and selection of data to be displayed during automatic display scrolling;

Once the user has used the keyboard to input desired parameters for one or two bins, the keys in the lower right-hand portion of the control panel 33 are used to start or stop the control system:

RUN—causes the system to begin to run under the operational mode and other parameters selected.

MANUAL OFF—terminates aeration manually.

MANUAL ON—starts aeration manually.

Display module 60 includes sixteen identical fifteen-segment displays. The fifteen-segment displays may advantageously be MTAN4254-AHR LED-type displays (Marktech). They are driven in a refreshing cycle by the four 74LS374 latches (Fairchild) U9–U11 that sequentially receive the data to be displayed and their corresponding UDN2981 source drivers U16–18 (Sprague). Data (two bytes) latched in with the SEG3, SEG4 lines define one character for one of the eight displays in the left-hand half of the display 48. Data latched in with the SEG1, SEG2 lines define one character for one of the eight displays in the right-hand half of the display 48. Actually the data are signalled to all eight displays in the affected half, but an additional byte of data latched to the fifth 74LS374 (U8) connected to the UDN2597A sink driver U22 (Sprague) is necessary to determine which pair of characters—one in each half of the display 48—is illuminated. After lines SEG-1–SEG4 are used sequentially to load the latches, the line DIG1 is used to send one byte of data from U8 to sink driver U22. The latter permits cathode circuits from the various characters to be completed, two characters at a time. The CPU picks, for example, the second character in both halves or the third, etc., moving in sequence. Thus, the various characters are actually powered only a small fraction of the time, but the entire display 48 is refreshed often enough to appear to be continuously illuminated.

Air and grain temperatures and air humidity are sensed by sensing modules 70, 72, respectively. The data from these is selected under the control of the processing unit 58 via the sensor data processing module 90 communicating on the data bus 94 to I/O selection switch circuit 76, which controls the 4066 CMOS switches that select analog sensor voltages for input to the A-to-D converter. Each temperature sensor uses a 8M3002-C3 thermistor (Dale) with surge protector diodes, precision 0.1% resistors (Dale) and an LM324 (National Semiconductor) differential amplifier/buffer U15. The resistors and amplifier/buffers provide scaling.

The humidity sensing module 72 uses an H1 variable capacitance humidity sensor (Mepco Electra, a Phillips company) with one 7556 dual timer (Intersil) and a 4001 quad NOR buffer (Motorola). A reference capacitor and one timer produce a reference signal of standard frequency, which is NOR-ed with the variable frequency signal produced by the humidity sensor H1 and the other timer. The resulting signal contains humidity data coded in its duty cycle. This signal is converted to a voltage and fed to an LM324 scaling buffer U3–5, which yields a scaled sensor voltage selectable for conversion in the ADC0803 to A-to-D converter.

Aeration fan control occurs in fan actuation circuit 68 as a result of signals supplied on the data bus 94 to the 74LS374 eight-bit latch U5. A first fan is controlled by the output at 6Q. A second fan is controlled by the output at 8Q. As the fan actuation circuitry for each output is identical, only one will be described. Connected to 6Q is a MOC 3060 (Motorola) opto-isolator U26, which, in turn, is connected to an MAC 15-6 (Motorola) triac Q2. The triac drives a relay (not shown) via control lead 46 that controls power to the fan 26. A second fan, if present in an installation, would be controlled in like manner.

In some applications, communication with the CPU 78 may be desired. A communications interface circuit 98 connected to lines P10–P17 uses one 74LS14 hex Schmitt trigger U7 and one DS1489 quad line receiver U24 and forms an RS232C port. In applications where a user can receive a power interrupt signal from the power company to signal load shedding, the CPU 78 can receive this signal on pin 8 and aeration can be interrupted. Interrupt circuit 99 handles the interrupt signal.

Incorporated by reference is Appendix A which is the source code for a program written in Microsoft C and Assembler for the 8051 family of microprocessors. This program, as compiled, is contained within EPROM 80 for governing operation of CPU 78. This source code also specifies the computational and algorithmic details for the method of the present invention.

While the preferred embodiment of the invention has been illustrated and described, it is to be understood that the invention is not limited to the precise method and apparatus herein disclosed, and the right is reserved to all variations coming within the scope of the appended claims. For example, it will be clear that the invention will work in storage bins with a variety of shapes and will work as well with duct-type air delivery systems or with fan arrangements that pull air down through the grain rather than by pushing it up through a plenum.

Likewise it is clear that the method could be performed by other comparable circuitry or information processing means.

What is claimed as new and desired to be protected by Letters Patent is:

1. A method for controlling aeration of stored grain of a specified type that is to be maintained at or near a specified desired grain moisture content, comprising the steps of:

(a) measuring the current ambient air temperature;

(b) measuring the current ambient air relative humidity level;

(c) determining for the specified grain type the equilibrium moisture content corresponding to said current ambient temperature and relative humidity measurements;

(d) determining a short term running average ambient temperature from a plurality of time-spaced measurements of ambient air temperature taken over a specified first period of time;

(e) determining a long term running average ambient temperature from a plurality of time-spaced measurements of ambient air temperature taken over a specified second period of time, substantially longer than said first period of time;

(f) determining the difference between said short term and long term running average ambient temperatures;

(e) defining an acceptable range of ambient temperatures around said short term running average ambient temperature during which grain aeration can occur, using said short term running average ambient temperature as the range centerpoint;

(h) defining an acceptable range of grain moisture content around said desired grain moisture content during which grain aeration can occur;

(i) adjusting the centerpoint of the acceptable range of ambient temperatures downward by a specified offset when it is determined that the short term running average ambient temperature is a predetermined amount lower than the long term running average ambient temperature; and (j) aerating said grain when the current ambient air temperature is within said defined acceptable temperature range, including any offset adjustment thereto, and said equilibrium moisture content is within said defined acceptable grain moisture content range.

2. The method as recited in claim 1 including the step of widening the acceptable range around said short term running average ambient temperature when less than a predetermined amount of aeration has occurred.

3. The method as recited in claim 1 wherein the specified offset used for downward adjustment of the centerpoint of the acceptable range of ambient temperature is proportional to the difference between the short term and long term running average temperatures.

4. The method as recited in claim 1 wherein the predetermined amount of difference between the short term and long term running average ambient temperatures that leads to adjustment is one degree F. or greater.

5. The method as recited in claim 1, said predetermined acceptable temperature range being within plus or minus 50° F. around said running average ambient temperature range centerpoint.

6. The method as recited in claim 5, said predetermined acceptable temperature range being within plus or minus 1° F. around said running average ambient temperature range centerpoint.

7. The method as recited in claim 1, further comprising the steps of selecting a desired available aeration time during a specified time period and inhibiting the step of aerating when the desired available aeration time has been consumed.

8. The method as recited in claim 7, further comprising the step of accumulating that portion of the desired available aeration time not used during each of said specified time periods when said current ambient air temperature and said equilibrium moisture content are not within their respective predetermined acceptable ranges, thereby increasing the desired available aeration time of subsequent time periods.

9. The method as recited in claim 1 including the step of widening the acceptable range around said desired grain moisture content when less than a predetermined amount of aeration has occurred.

10. The method as recited in claim 9 wherein the acceptable range around said desired moisture content is widened to a greater extent when the short term average temperature is less than a specified temperature.

11. A method for controlling aeration of stored grain of a specified type that is to be maintained at or near a specified desired grain moisture content, comprising the steps of:

(a) measuring the current ambient air temperature;

(b) measuring the current ambient air relative humidity level;

(c) determining for the specified grain type the equilibrium moisture content corresponding to said current ambient temperature and relative humidity measurements;

(d) determining a short term running average ambient temperature from a plurality of time-spaced measurements of ambient air temperature taken over a specified first period of time;

(e) determining a long term running average ambient temperature from a plurality of time-spaced measurements of ambient air temperature taken over a specified second period of time, substantially longer than said first period of time;

(f) determining the difference between said short term and long term running average ambient temperatures;

(g) defining an acceptable range of ambient temperatures around said short term running average ambient temperature, during which grain aeration can occur, said range having upper and lower boundaries;

(h) defining an acceptable range of grain moisture content around said desired grain moisture content during which grain aeration can occur;

(i) adjusting the upper and lower boundaries of the acceptable range of ambient temperatures downward by a specified offset, when it is determined that the short term running average ambient temperature is a predetermined amount lower than the long term running average ambient temperature; and (j) aerating said grain when the current ambient air temperature is within said defined acceptable temperature range, including any offset adjustment thereto, and said equilibrium moisture content is within said defined acceptable grain moisture content range.

12. The method as recited in claim 11, including the step of widening the acceptable range around said short term running average ambient temperature when less than a predetermined amount of aeration has occurred.

13. The method as recited in claim 11 wherein the specified offset used for downward adjustment of the boundaries of the acceptable range of ambient temperatures is proportional to the difference between the short term and long term running average temperatures.

14. The method as recited in claim 11 wherein the predetermined amount of difference between the short term and long term running average ambient temperatures that leads to adjustment is one degree or greater.

15. The method as recited in claim 11, said predetermined acceptable temperature range being within plus or minus 50° F. around said short term running average ambient temperature.

16. The method as recited in claim 15, said predetermined acceptable temperature range being within plus or minus 1° F. around said short term running average ambient temperature.

17. The method as recited in claim 11 further comprising the steps of selecting a desired available aeration time during a specified time period and inhibiting the step of aerating when the desired available aeration time has been consumed.

18. The method as recited in claim 17 further comprising the step of accumulating that portion of the desired available aeration time not used during each of said specified time periods when said current ambient air temperature and said equilibrium moisture content are not within their respective predetermined acceptable ranges, thereby increasing the desired available aeration time of subsequent time periods.

19. The method as recited in claim 10 including the step of widening the acceptable range around said desired grain moisture content during which aeration can occur when less than a predetermined amount of aeration has occurred.

20. The method as recited in claim 19 wherein the acceptable range around said desired moisture content is widened to a greater extent when the short term average temperature is less than a specified temperature.

21. An apparatus for controlling aeration of stored grain of a specified type that is to be maintained at or near a specified desired grain moisture content, comprising:

(a) means for measuring the current ambient air temperature;

(b) means for measuring the current ambient air relative humidity level;

(c) means for determining for the specified grain type the equilibrium moisture content corresponding to said current ambient temperature and relative humidity measurements;

(d) means for determining a short term running average ambient temperature from a plurality of time-spaced measurements of ambient air temperature taken over a specified first period of time;

(e) means for determining a long term running average ambient temperature from a plurality of time-spaced measurements of ambient air temperature taken over a specified second period of time, substantially longer than said first period of time;

(f) means for determining the difference between said short term and long term running average ambient temperatures;

(g) means for defining an acceptable range of ambient temperatures around said short term running average ambient temperature, during which grain aeration can occur, said range having upper and lower boundaries;

(h) means for defining an acceptable range of grain moisture content around said desired grain moisture content during which grain aeration can occur;

(i) means for adjusting the upper and lower boundaries of the acceptable range of ambient temperatures downward by a specified offset, when it is determined that the short term running average ambient temperature is a predetermined amount lower than the long term running average ambient temperature; and (j) means for aerating said grain when the current ambient air temperature is within said defined acceptable temperature range, including any offset adjustment thereto, and said equilibrium moisture content is within said defined acceptable grain moisture content range.

22. Apparatus as recited in claim 21 further comprising means for widening the acceptable range around said short term running average ambient temperature when less than a predetermined amount of aeration has occurred.

23. Apparatus as recited in claim 21 wherein said means for adjusting makes an adjustment proportional to the difference between the short term and long term running average temperatures.

24. Apparatus as recited in claim 21 wherein said means for adjusting makes an adjustment equal to the difference between the short term and long term running average temperatures.

25. Apparatus as recited in claim 21 further comprising means for widening the acceptable range around said desired grain moisture content during which aeration can occur when less than a predetermined amount of aeration has occurred.

26. Apparatus as recited in claim 25 wherein the acceptable range around said desired moisture content is widened to a greater extent when the short term average temperature is greater than or less than certain specified temperatures.

* * * * *